US007742736B2

(12) United States Patent
Kobayashi et al.

(10) Patent No.: US 7,742,736 B2
(45) Date of Patent: Jun. 22, 2010

(54) SHEET SIZE DETECTING APPARATUS

(75) Inventors: Shinsuke Kobayashi, Susono (JP); Jun Agata, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 894 days.

(21) Appl. No.: 11/474,378

(22) Filed: Jun. 26, 2006

(65) Prior Publication Data

US 2007/0002089 A1 Jan. 4, 2007

(30) Foreign Application Priority Data

Jun. 29, 2005 (JP) ..... 2005-189932
Nov. 1, 2005 (JP) ..... 2005-318609
Jun. 21, 2006 (JP) ..... 2006-171827

(51) Int. Cl.
*G03G 15/00* (2006.01)

(52) U.S. Cl. ..... 399/389; 399/370; 399/371; 399/376; 271/226; 271/258.01; 271/259; 271/261

(58) Field of Classification Search ..... 399/370, 399/371, 376, 389; 271/226, 258.01, 259, 271/261

See application file for complete search history.

(56) References Cited

U.S. PATENT DOCUMENTS 5,332,208 A 7/1994 Tsuji et al. ..... 271/171
2005/0218586 A1 10/2005 Agata ..... 271/226
2005/0242493 A1 11/2005 Agata ..... 271/226
2006/0181003 A1 8/2006 Agata ..... 271/186

FOREIGN PATENT DOCUMENTS

| | | |
|---|---|---|
| JP | 3-255304 | 11/1991 |
| JP | 4-136882 | 5/1992 |
| JP | 6-144639 | 5/1994 |
| JP | 8-119534 | 5/1996 |
| JP | 8-290849 | 11/1996 |
| JP | 9-315621 | 12/1997 |
| JP | 10-181891 | 7/1998 |
| JP | 11-116097 | 4/1999 |
| JP | 3483233 | 10/2003 |

*Primary Examiner*—Judy Nguyen
*Assistant Examiner*—Andy L Pham
(74) *Attorney, Agent, or Firm*—Fitzpatrick, Cella, Harper & Scinto

(57) ABSTRACT

A sheet size detecting apparatus having a first arm moved by a moving sheet contacting therewith, a second arm moved by the moving sheet contacting therewith, the second arm being disposed at a location differing from that of the first arm in a direction orthogonal to the movement direction of the sheet, and a sensor, wherein the output level of the sensor when only one of the first arm and the second arm has been moved is the same as the output level thereof when neither of the first arm and the second arm is moved, and the output level of the sensor when both of the first arm and the second arm have been moved differs from the output level thereof when neither of the first arm and the second arm is not moved. Thereby, the cost can be suppressed and yet, the wrong detection of the sheet size can be prevented.

8 Claims, 21 Drawing Sheets

SHEET SIZE DETECTING APPARATUS

BACKGROUND OF THE INVENTION

1. Field of the Invention

This invention relates to a sheet size detecting apparatus carried on an image forming apparatus such as a copying machine or a printer.

2. Related Background Art

For example, an image forming apparatus such as a copying machine or a printer using the electrophotographic technique forms a toner image on a recording material (sheet) such as a plain paper, and thereafter heats and fixes the toner image on the recording material by a fixing device.

Now, it is known that when small size recording materials are continuously printed at the same print intervals as large size recording materials, an area of the fixing device through which the recording materials do not pass (non-sheet passing area) excessively rises in temperature. When the non-sheet passing area of the fixing device excessively rises in temperature, parts constituting the fixing device are damaged by heat, or when a large size recording material is passed in a state in which the non-sheet passing area of the fixing device has excessively risen in temperature, there may occur a phenomenon that the toner offsets on the fixing device (high temperature offset).

So, when continuous printing is to be effected on small size recording materials, the excessive rise in the temperature of the non-sheet passing area is suppressed by taking a measure such as adopting the setting for widening the print interval more than when continuous printing is effected on large size recording materials.

To execute control for suppressing such excessive rise in the temperature of the non-sheet passing area of the fixing device, it is necessary for the image forming apparatus to recognize whether the recording material being conveyed is larger or smaller than a reference size.

FIG. 12 of the accompanying drawings shows a conventional example of means installed in an image forming apparatus for detecting the size of paper.

The letter A designates a sheet conveying path including a pair of sheet conveying rollers 4*a* and 4*b*, and in the case of this example, sheets of two kinds of sizes, i.e., a small size sheet S1 and a large size sheet S2, are conveyed by this conveying path A so that a conveyance reference O-O and the center of the sheet in the width direction thereof (direction orthogonal to a conveyance direction) may coincide with each other (center reference). A1 denotes a conveyance with area for the small size sheet S1 in the sheet conveying path A, A2 designates a conveyance width area for the large size sheet S2, and B denotes the difference area between the conveyance width areas A1 and A2 of the small size sheet S1 and the large size sheet S2.

The reference numerals 101, 102 designate two sets of first and second sheet size detecting means, and the first sheet size detecting means 101 is disposed correspondingly to a location in the conveyance width area A1 for the small size sheet S1, and the second sheet size detecting means 102 is disposed correspondingly to a location in the difference area B between the conveyance width areas A1 and A2.

The first and second sheet size detecting means 101 and 102 have arms 101*a* and 102*a*, respectively, pivotally moved by the contact thereof with the sheet, and sensors 101*b* and 102*b*, respectively, for detecting the pivotal movement of the arms. In the case of the present example, the arms 1 101*a* and 102*a* are rocking members each having an upper arm portion and a lower arm portion pivotally movable about supporting shafts 101*c* and 102*c*, respectively, and the sensors 101*b* and 102*b* are photointerrupters each having a light emitting portion and a light receiving portion. The rocking members 101*a* and 102*a* are both kept in a substantially vertical upright posture by gravity in their free state.

When the sheet passed to the conveying path A is the small size sheet S1, the leading edge of the sheet S1 interferes with the upper arm portion of the rocking member 101*a* of the first sheet size detecting means 101. By this contact, the rocking member 101*a* is pivotally moved in a counter-clockwise direction about the supporting shaft 101*c*, and this pivotally moved state of the rocking member 101*a* is kept until the trailing edge of the sheet S1 has passed the position of the rocking member 101*a*. This pivotally moved state of the rocking member 101*a* is detected by the photointerrupter 101*b*, and the output signal of the photointerrupter changes from "open" to "close".

On the other hand, the rocking member 102*a* of the second sheet size detecting means 102 is free of the contact by the conveyed sheet S1 because the location thereof is outside the conveyance width area A1 for the small size sheet S1, and the output signal of the photointerrupter 101*b* remain in the open signal state.

From the change of the output signal of the photointerrupter 101*b* of the first sheet size detecting means 101 from the open state to the closed state after the passing of the sheet has been done, and the duration of the open state of the output signal of the photointerrupter 102*b* of the second sheet size detecting means 102, a control circuit, not shown, judges that the passed sheet is the small size sheet S1.

When the sheet passed to the conveying path A is the large size sheet S2, the rocking members 101*a* and 102*a* of the first and second sheet size detecting means 101 and 102 are pivotally moved by the sheet S2 because the locations of both of them are within the conveyance width area A2 of the large size sheet S2, and both of the output signals of the photointerrupters 101*b* and 102*b* of the first and second sheet size detecting means 101 and 102 change form the open state to the closed state. Thereby, the control circuit, not shown, judges that the fed sheet is the large size sheet S2.

Even when the sizes of the passed sheets are three or more kinds, the number of the sheet size detecting means is increased, whereby the detection of the sizes of the sheets is possible.

However, in an image forming apparatus of a construction in which the width regulation of the sheet is effected with the center reference, and in which sheet size detecting means is provided only on one side in the width direction of the sheet, there has arisen the problem of the wrong detection of the sheet size that a sheet which should originally be detected as a small size sheet is detected as a large size sheet.

More particularly, in the case of a construction as shown in FIG. 8 of the accompanying drawings wherein for example, the width regulation of a sheet 25 is effected with the center reference, sheet passing is usually effected with the center reference with regulating guides 2 brought into contact with the sheet 25. In this case, the sensor arm 5*b* of a sheet width sensor is not brought down. However, when sheet passing should be done with the center reference with the regulating guides 2 brought into contact with the opposite side edges of the sheet 25, if as shown in FIG. 9 of the accompanying drawings, sheet passing is done with the regulating guides 2 not brought into contact with the opposite side edges of the sheet 25, the sheet 25 is passed while leaning toward the sensor arm 5*b* side of the sheet width sensor with the regulating guides 2 widely spaced apart from each other, whereby the sensor arm 5*b* of the sheet width sensor is brought down.

As the result, there arises the problem of wrong detection that the sheet is detected as a large size sheet. This wrong detection causes such difficulties as the aforementioned "temperature rise phenomenon of the non-sheet passing portion" and "high temperature offset". This will further to lead to the damage of the fixing device and the trouble of a main body due to the excessive rise in the temperature of the non-sheet passing portion.

To prevent such wrong detection and accurately detect the size of a sheet, arms and sensors must be provided on the left and right sides relative to the conveyance reference O-O of the sheet, and the number of the sensors has been increased to thereby increase the cost.

SUMMARY OF THE INVENTION

The present invention has been made in view of the above-noted problems and an object thereof is to provide a sheet size detecting apparatus which can suppress the cost and yet, can prevent the wrong detection of a sheet size.

Another object of the present invention is to provide a sheet size detecting apparatus comprising:

a first arm moved by a moving sheet contacting therewith;

a second arm moved by the moving sheet contacting therewith, the second arm being disposed at a location differing from that of the first arm in a direction orthogonal to the movement direction of the sheet; and a sensor;

wherein the output level of the sensor when only one of the first arm and the second arm has been moved is the same as the output level thereof when neither of the first arm and the second arm is moved, and the output level of the sensor when both of the first arm and the second arm have been moved differs from the output level thereof when neither of the first arm and the second arm is moved.

Still another object of the present invention is to provide a sheet size detecting apparatus comprising:

a first arm moved by a moving sheet contacting therewith;

a second arm moved by the moving sheet contacting therewith, the second arm being disposed at a location differing from that of the first arm in a direction crossing the movement direction of the sheet;

a sensor; and an actuator for acting on the sensor;

wherein the actuator is not moved when one of the first arm and the second arm is moved by the contact of the sheet, and is moved when both of the first arm and the second arm are moved by the contact of the sheet.

Yet still another object of the present invention is to provide a sheet size detecting apparatus comprising:

a first arm moved by a moving sheet contacting therewith;

a second arm moved by the moving sheet contacting therewith, the second arm being disposed at a location differing from that of the first arm in a direction crossing the movement direction of the sheet; and a sensor;

wherein the first arm has a first actuator portion for acting on the sensor, and the second arm has a second actuator portion for acting on the sensor.

Further objects of the present invention will become apparent from the following detailed description when read with reference to the accompanying drawings.

DESCRIPTION OF THE PREFERRED EMBODIMENTS

First Embodiment

Figure 2:
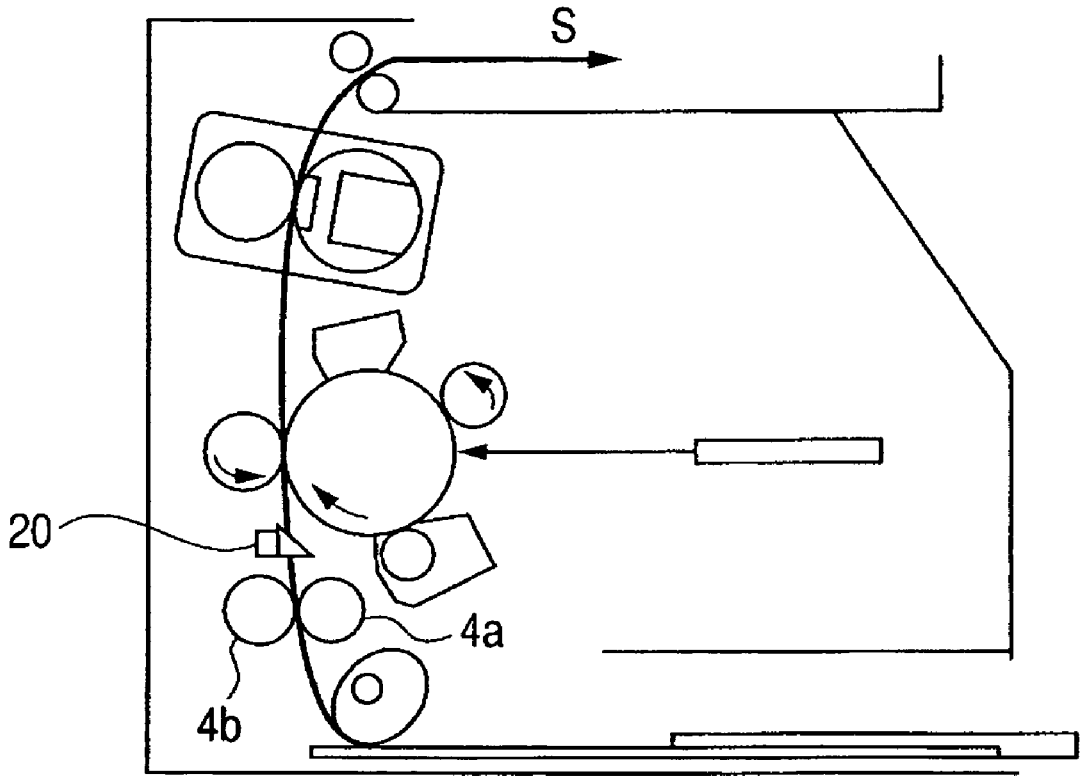
FIG. 2 schematically shows the construction of an image forming apparatus carrying thereon the sheet size detecting apparatus according to first Embodiment.

FIG. 2 schematically shows the construction of an example of an image forming apparatus carrying the sheet size detecting apparatus of the present invention thereon. The image forming apparatus according to the present embodiment is a laser beam printer utilizing a transfer type electrophotographic recording process. The electrophotographic recording process for forming an image on a recording material (sheet) is of a well-known construction and therefore need not be described here, but the epitome of the electrophotographic recording process will be described later with reference to FIG. 13 and reference should be made to that description.

Figure 3:
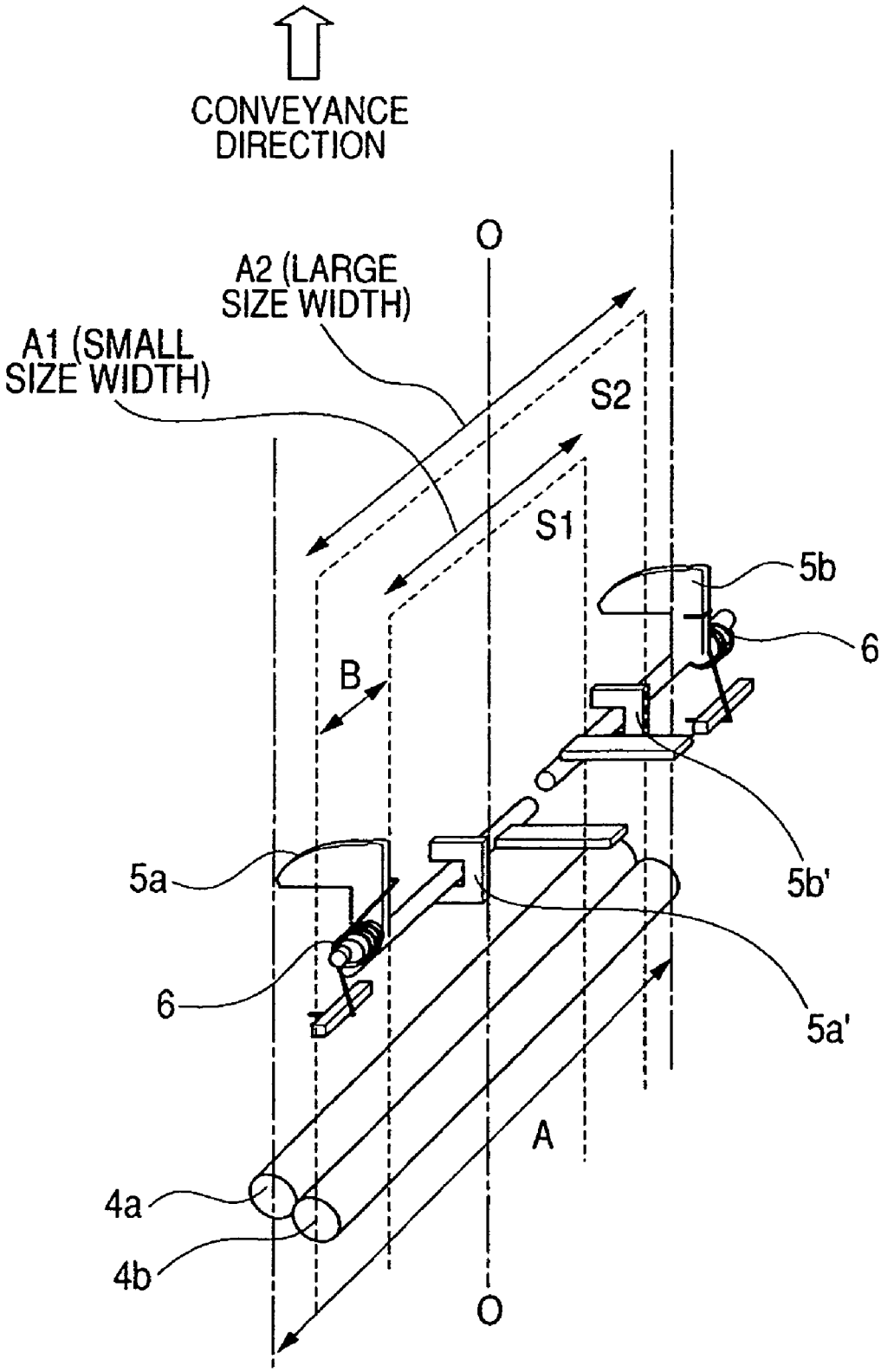
FIG. 3 is a perspective view showing the positional relations between the sizes of sheets and the first and second arms of the sheet size detecting apparatus.
Figure 12:
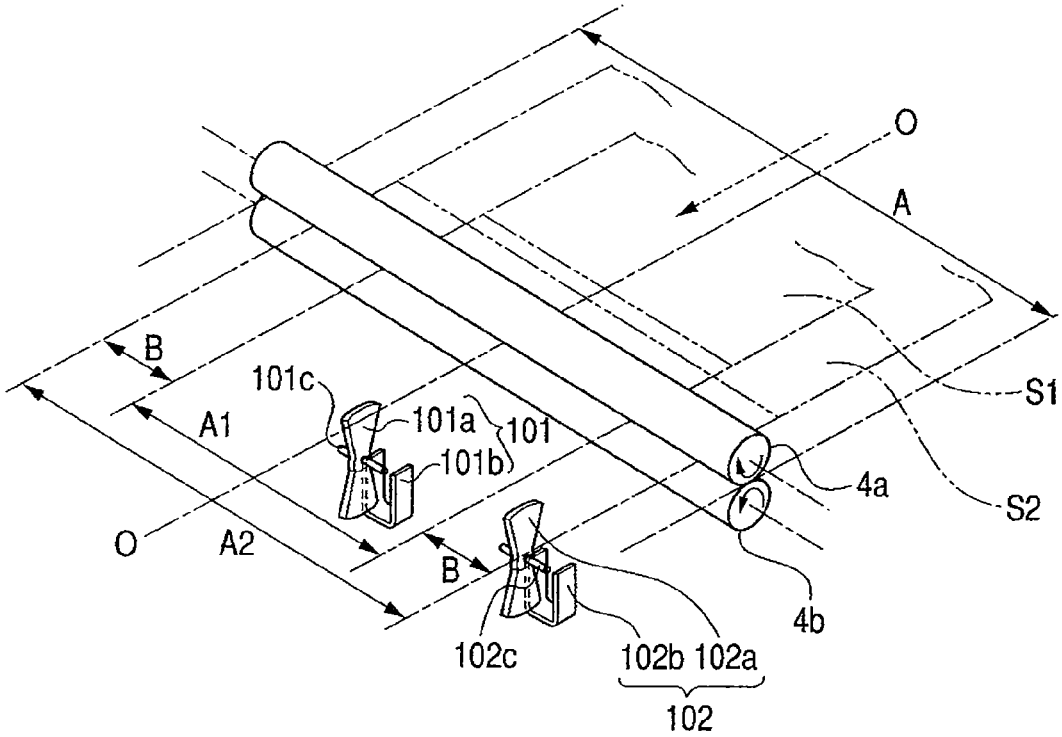
FIG. 12 PRIOR ART
FIG. 12 is a perspective view showing sheet size detecting means according to a conventional example.

In the present embodiment, description will hereinafter be made of the details of sheet width size detecting means (sheet size detecting apparatus) 20 disposed in the laser beam printer of FIG. 2. FIG. 3 is a perspective view of a conveying path including a portion of the sheet width size detecting means 20. The letter A designates a sheet conveying path including a pair of sheet conveying rollers 4*a* and 4*b*, and in the case of the present embodiment, as in the aforedescribed case of FIG. 12, it is to be understood that sheets of two kinds of sizes, i.e., a small size sheet S1 and a large size sheet S2, are conveyed on this conveying path A so that a conveyance reference O-O and the center of the sheet in the width direction thereof (direction orthogonal to a conveyance direction) may coincide with each other. A1 denotes a conveyance width area for the small size sheet S1 in the sheet conveying path A, A2 designates a conveyance width area for the large size sheet S2, and B denotes a difference area between the conveyance width areas A1 and A2 for the small size sheet S1 and the large size sheet S2.

Figure 4:
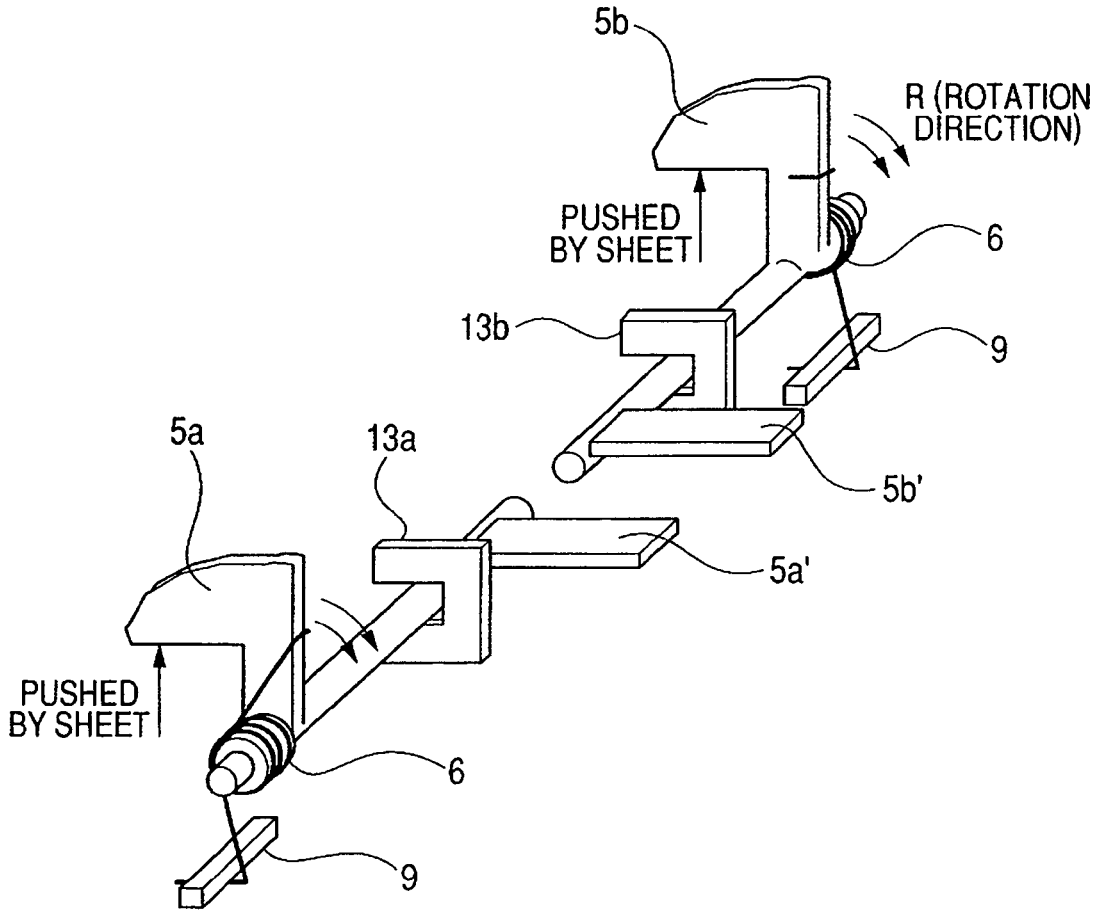
FIG. 4 is a perspective view for illustrating the constructions of the first and second arms of the sheet size detecting apparatus.

FIG. 4 shows the details of the detecting means 20. Sensor arms 5*a* and 5*b* are disposed for rotation by bearings 13*a* and 13*b* and against movement in a thrust direction. In the specification, the sensor arm 5*a* is defined as a first arm, while the sensor arm 5*b* is defined as a second arm. The second arm 5*b* is disposed at a location differing from that of the first arm 5*a* in a direction orthogonal to the movement direction of the recording material. Also, the first arm 5*a* is disposed in an area differing from the area in which the second arm 5*b* is disposed with the conveyance reference O-O of the recording material as the boundary in a direction orthogonal to the movement direction of the recording material. Also, the sensor arms 5*a* and 5*b* are kept in such a rotation angle posture state as shown in FIG. 4, by springs 6 and stoppers 9. When a sheet is conveyed to the areas of the sensor arms 5*a* and 5*b*, the sheet brings down the sensor arms 5*a* and 5*b* from below them, whereby the sensor arms are rotated in the direction of arrows R. By the sheet passing being finished, the sensor arms are designated to be returned to their fixed positions by the springs 6.

Figure 1:
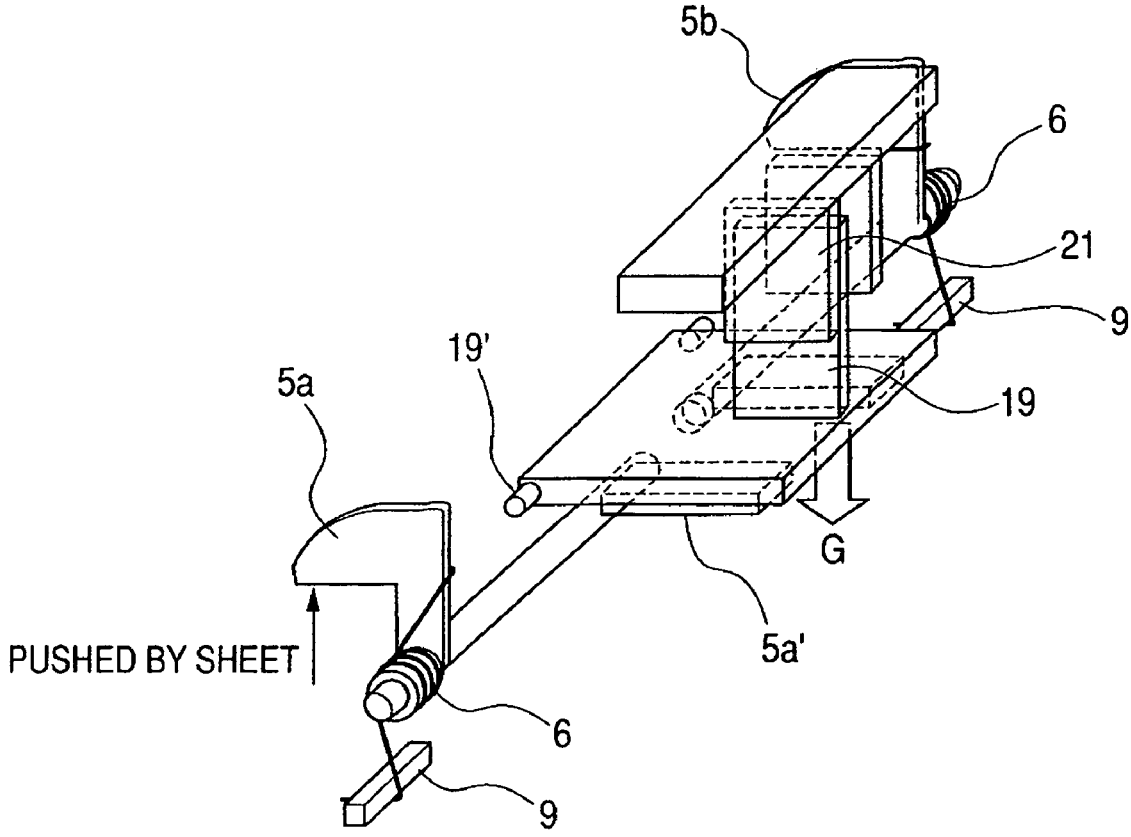
FIG. 1 is a perspective view of a sheet size detecting apparatus according to first Embodiment.

FIG. 1 is a schematic view in which a photointerrupter (sensor) 21 and a sensor flag (actuator) 19 for acting on this photointerrupter 21 are added to FIG. 4. The sensor flag 19 has a rotary shaft 19' differing from the sensor arms 5*a* and 5*b* of a sheet width sensor 5, and a force works in the direction of arrow G by gravity with the aforementioned rotary shaft 19' as an axis. Usually it keeps a horizontal state by being supported by end pieces (supporting portions) 5*a*' and 5*b*' secured integrally with and rotated by the sensor arms 5*a* and 5*b*. Accordingly, the sensor flag 19 is brought down in the direction of arrow G by gravity for the first time by the end pieces 5*a*' and 5*b*' of the sensor arms 5*a* and 5*b* being both brought down. That is, design is made such that the sensor flag 19 will not be brought down unless the sheet brings down both of the sensor arms 5*a* and 5*b*.

Figure 5:
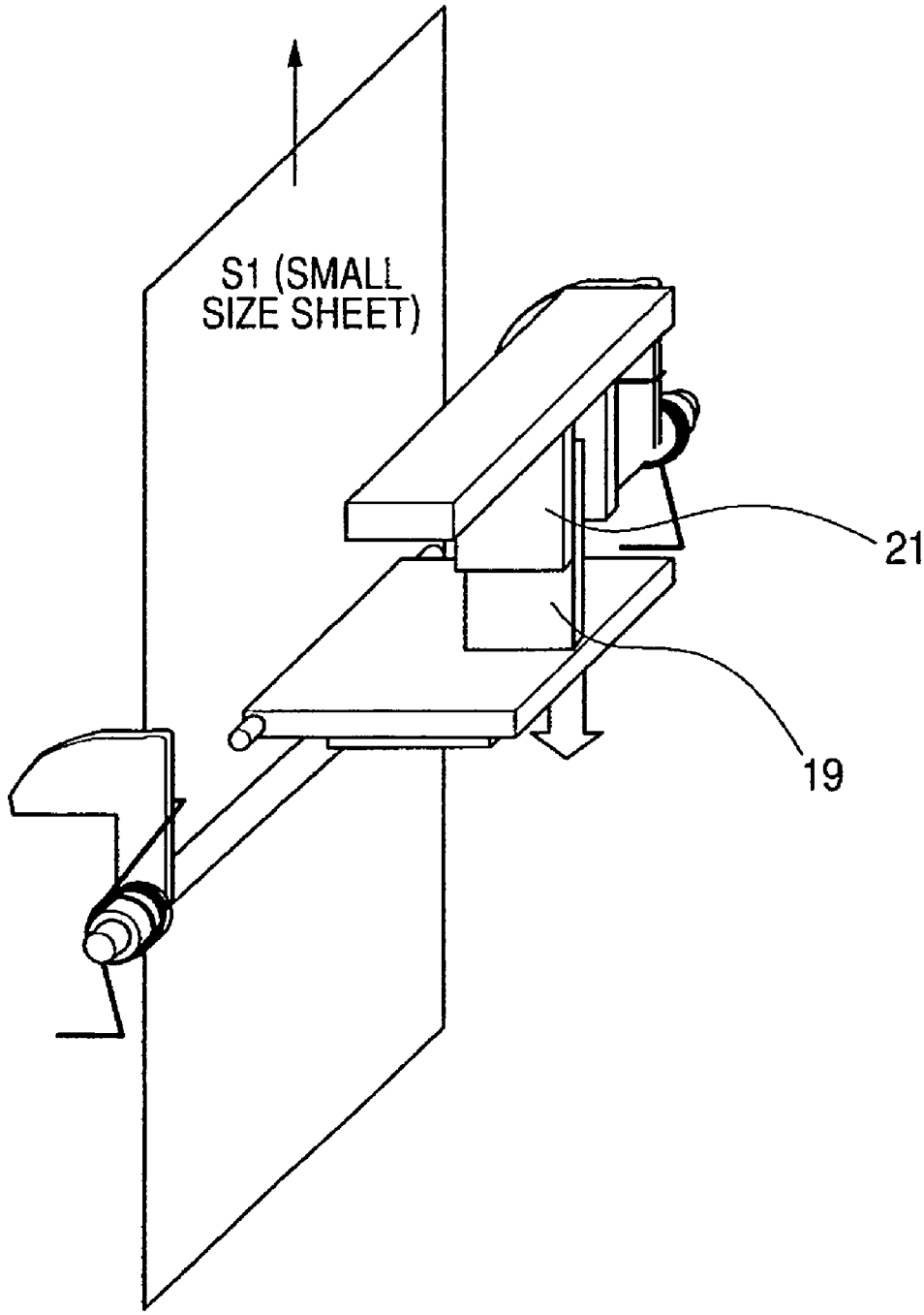
FIG. 5 is a perspective view showing the states of the first and second arms when a small size sheet has been passed with the center reference.

Thus, when the sheet passed to the conveying path A of FIG. 3 is the small size sheet S1, the sheet contacts with neither of the sensor arms 5*a* and 5*b*, as shown in FIG. 5, and therefore, the sensor arms are not rotated and the sensor flag 19 also keeps itself supported by the end pieces 5*a*' and 5*b*' of the sensor arms.

Figure 6:
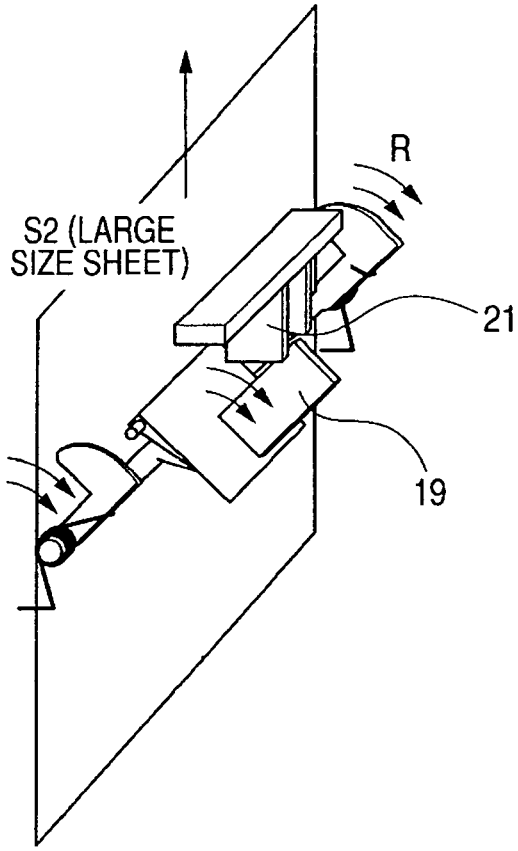
FIG. 6 is a perspective view showing the movement of the first and second arm when a large size sheet has been passed.

When the sheet passed to the conveying path A is the large size sheet S2, the leading edge of the sheet S2 contacts the sensor arms 5*a* and 5*b*, as shown in FIG. 6, and the sensor arms 5*a* and 5*b* are pushed and pivotally moved in the direction of arrow R, and are kept in contact with the underside of the conveyed sheet S2 until the trailing edge of the sheet S1 has passed the locations of the sensor arms 5*a* and 5*b*.

As long as the sensor arms 5*a* and 5*b* are both brought down, the sensor flag 19 also follows each of them and is rotatively displaced in the direction of arrow R to be a posture as shown in FIG. 6, and opens the optical path between the light emitting portion and light receiving portion of the photointerrupter 21, whereby the output signal of the photointerrupter 21 is changed from a closed signal state to an open signal state, and this opened state of the optical path is continued until the sheet S2 has passed the locations of the sensor arms 5*a* and 5*b*. Thus, from the signal change of one stage of "closed" to "open" of the output signal of this photointerrupter 21, it is detected and judged by a control circuit, not shown, that the sheet passed to the apparatus is the large size sheet S2.

Thereafter, the conveyed sheet S2 has passed the locations of the sensor arms 5*a* and 5*b*, whereupon the sensor arms 5*a* and 5*b* are both rotated in a direction opposed to the direction R by the action of the springs 6, and automatically return to their initial standby state, and the sensor flag 19 also follows it and returns to its original horizontal state, and the sensor flag 19 intercepts the optical path between the light emitting portion and light receiving portion of the photointerrupter 21. Along with this, the output signal of the photointerrupter 21 returns from the open signal state to the closed signal state, and the standby state is assumed.

Figure 10:
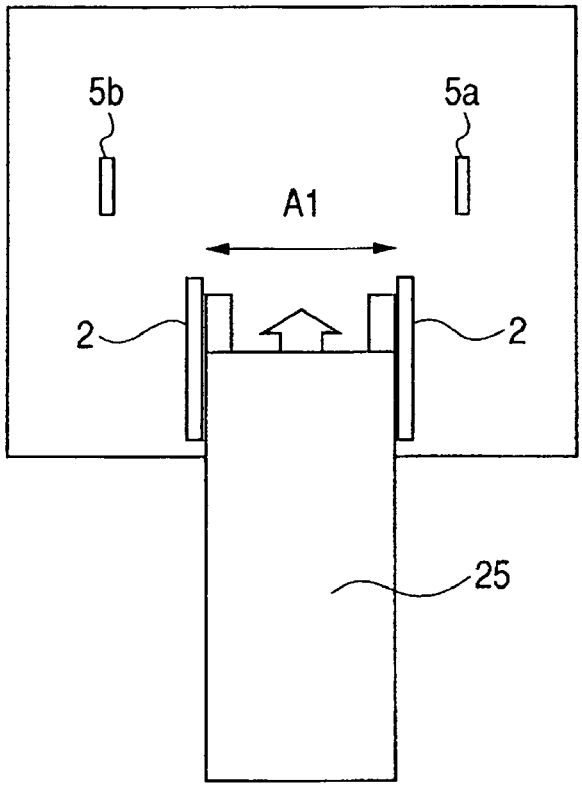
FIG. 10 shows a case where in an apparatus having two arms, a small size sheet is passed with the center reference.

Description will now be made of a case where the sheet passed to the conveying path A is the small size sheet S1 and is conveyed in a state in which the conveyance reference O-O and the center of the sheet 25 in the width direction thereof (direction orthogonal to the conveyance direction) do not coincide with each other. In a case where a small size sheet S1 is conveyed, as shown in FIG. 10, it is general to position a regulating guide at the position to fit the A1 size width in the center. However, by a user's unusual operation, it may also be caused, that the sheet 25 is passed along a regulating guide 2 with the regulating guide 2 while keeping a position for A2 size which is a large size width, as shown in FIG. 11.

In the conventional construction, a sheet width sensor was installed on only one of the sensor arm 5*a* and the sensor arm 5*b*, to thereby discern whether the sheet 25 being conveyed is the small size sheet S1 or the large size sheet S2. In such a construction, assuming that for example, one sensor arm 5A alone is provided, if the user passes the small size sheet S1 while abutting its side edge against the regulating guide 2 on the sensor arm 5*b* side, the sheet does not brings down the sensor arm 5*a* and therefore, the output signal of the photointerrupter 21 does not change, and the image forming apparatus recognizes the sheet as the small size sheet S1. However, if the user passes the small size sheet S1 while abutting its side edge against the regulating guide 2 on the sensor arm 5*a* side, the sheet brings down the sensor arm 5*a*, whereby the output signal of the photointerrupter 21 is changed from "closed" to "open", and the sheet is wrongly detected as the large size sheet S2.

Figure 7:
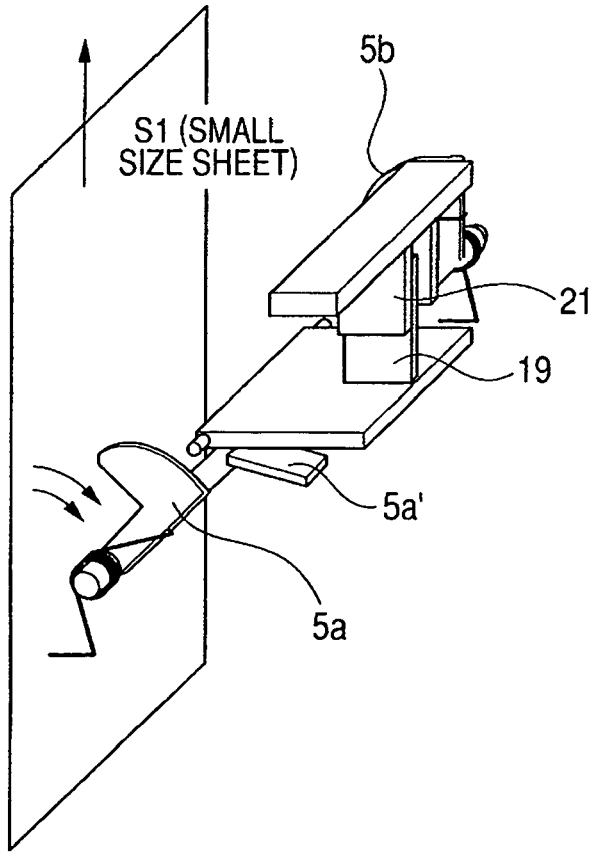
FIG. 7 is a perspective view showing the movement of the first and second arms when a small size sheet has been passed with an end portion reference.
Figure 8:
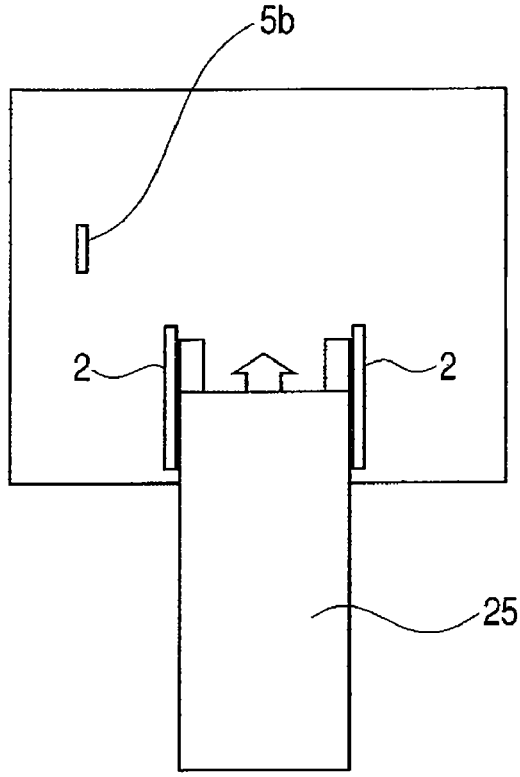
FIG. 8 PRIOR ART
FIG. 8 shows a case where in an apparatus having only one arm, a small size sheet is passed with the center reference.
Figure 9:
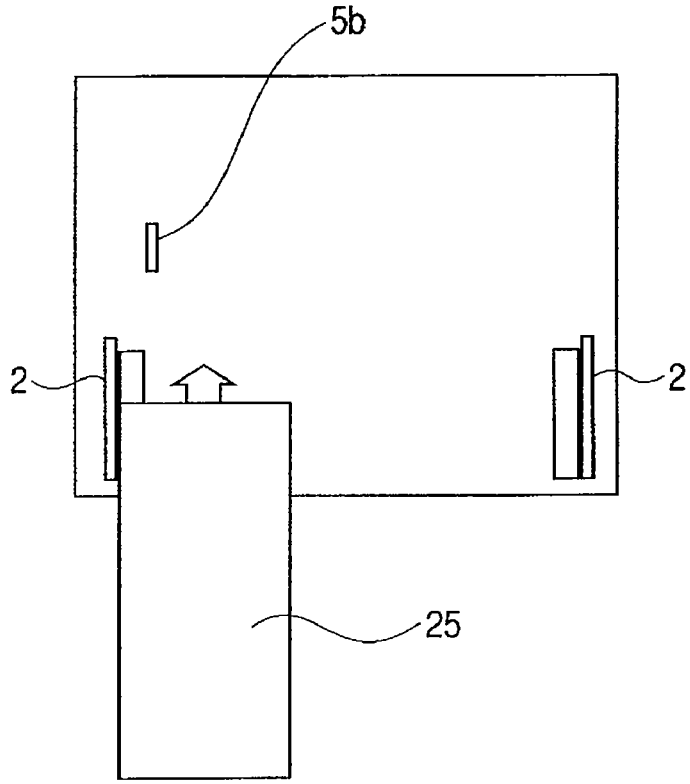
FIG. 9 PRIOR ART
FIG. 9 shows a case where in the apparatus having only one arm, a small size sheet is passed with the end portion reference.
Figure 11:
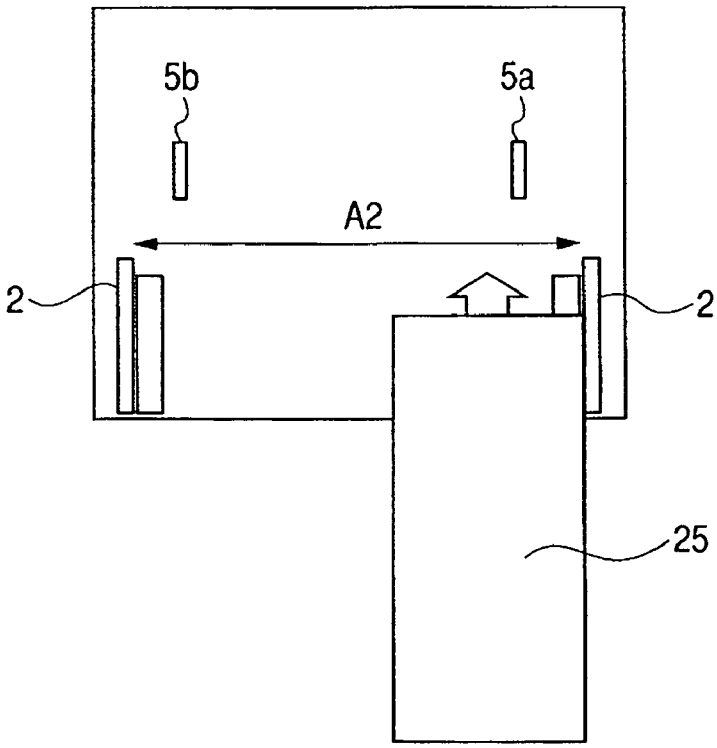
FIG. 11 shows a case where in the apparatus having two arms, a small size sheet is passed with the end portion reference.

In the case of the present embodiment, however, even if the sheet passing as shown in FIG. 11 is effected, or even if as shown in FIG. 7, the sheet 25 brings down the sensor arm 5*a* to thereby downwardly rotate the end piece 5*a*' (first supporting portion) of the sensor arm, the sensor arm 5*b* will not be rotated, and the end piece 5*b* (second supporting portion) of the sensor arm supports the sensor flag 19, whereby the sensor flag 19 is not brought down in the direction of arrow G by gravity, and the output signal of the photointerrupter 21 remains closed, and is not changed from "closed" to "open".

Table 1 below shows four detection patterns conceivable in the present embodiment. In Table 1, "home position" indicates a state in which the arms are not rotated, and "rotation" indicates a state in which the arms are rotated. Also, "close" indicates a state in which the optical path of the photointerrupter is intercepted by the actuator 19, and "open" indicates a state in which the optical path of the photointerrupter is not intercepted by the actuator 19.

TABLE 1

| detection pattern | 1st arm 5a | 2nd arm 5b | output of photointerrupter 21 | result of size judgment |
|---|---|---|---|---|
| 1 | home position | home position | Low (close) | small size |
| 2 | home position | rotation | Low (close) | small size |
| 3 | rotation | home position | Low (close) | small size |
| 4 | rotation | rotation | High (open) | large size |

As noted above, in the case of the present embodiment the output level (Low) of the sensor 21 when only one of the first arm 5*a* and the second arm 5*b* has been moved (detection patterns 2 and 3) is the same as the output level (Low) when neither of the first arm 5*a* and the second arm 5*b* is moved (detection pattern 1), and the output level (High) of the sensor 21 when both of the first arm 5*a* and the second arm 5*b* have been moved (detection pattern 4) differs from the output level (Low) when neither of the first arm 5*a* and the second arm 5*b* is moved (detection pattern 1).

Also, the sensor flag (actuator) 19 is designed to be not moved when one of the first arm 5*a* and the second arm 5*b* is moved by the contact of the recording material therewith (detection patterns 2 and 3), and to be moved when both of the first arm 5*a* and the second arm 5*b* are moved by the contact of the recording material therewith (detection pattern 4).

Accordingly, in the present embodiment, even in a rare case where the small size sheet is passed with the spacing between the regulating guides 2 made into a width for the large size sheet, the sheet width size can be recognized as the small size sheet S1 without the number of sensors such as costly photointerrupters being increased.

Also, it is preferable that these sensors on the left and right sides be disposed between the conveyance reference O-O and 80 mm-105 mm.

Figure 13:
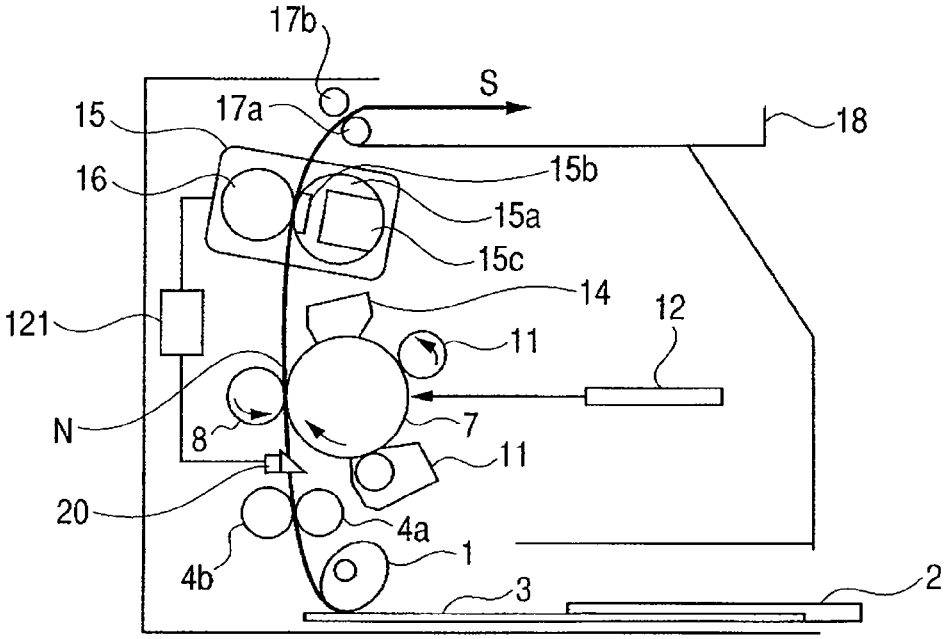
FIG. 13 schematically shows the construction of an image forming apparatus carrying a sheet size detecting apparatus thereon.

There will now be shown an example of the control effected by the engine of the image forming apparatus on the basis of the size of the recording material detected by the above-described sheet size detecting apparatus. FIG. 13 schematically shows the construction of a laser beam printer provided with a sheet width size detecting apparatus 20.

A sheet feeding table 3 for the sheet (recording material) S are provided at the bottom. A movable type sheet width regulating guide 2 is provided on the sheet feeding table 3, and the regulating guide 2 serves to bring the sheet S inserted from the sheet feeding table into the apparatus near the center relative to the width direction thereof and regulate it to the center conveyance reference.

The sheet S inserted from the sheet feeding table 3 into the apparatus is drawn into the apparatus by a sheet feeding roller 1 being rotatively driven at a predetermined control point of time after the insertion thereof has been detected by detecting means, not shown. Further, the sheet S is nipped and conveyed by a pair of conveying rollers 4*a* and 4*b*, and is introduced into a transferring portion N which is the pressure contact nip portion between a rotatable photosensitive drum 7 and a transfer roller 8 at predetermined timing, and receives the transfer of a toner image formed and borne on the outer peripheral surface of the rotatable photosensitive drum 7.

The sheet width size detecting means 20 is disposed in the sheet conveying path between the pair of conveying rollers 4*a* and 4*b* and the transferring portion N.

The sheet having receiving the transfer of the toner image in the transferring portion N is separated from the surface of the rotatable photosensitive drum 7, is introduced into heat-fixing means 15 and is subjected to the heat-fixing process of the unfixed toner image, and is discharged from a pair of sheet discharging rollers 17*a* and 17*b* onto a sheet discharging tray 18 in a face-down mode with the image surface thereof facing down, in the case of the present embodiment.

A laser scanner 12 which is provided at a position beside a rotatable photosensitive drum 7 and output and emit a modulated laser beam corresponding to a digital pixel signal inputted thereto from a host apparatus such as a computer or an image reading apparatus, not shown, and scans and exposes the surface of the rotatable photosensitive drum 7 by and to the laser beam through the intermediary of a turn-back mirror.

In the rotation direction of the A charging roller 11 which uniformly charges the surface of the rotatable photosensitive drum 7 to a predetermined polarity and predetermined potential, and the above-described laser beam scanning and exposure is done on the surface of the rotatable photosensitive drum 7 uniformly charged by this charging roller 11, whereby an electrostatic latent image corresponding to image information is formed on the surface of the rotatable photosensitive drum 7.

The electrostatic latent image is visualized as a toner image by a developing device 10, and the toner image is transferred to the sheet S in the afore-described transferring portion N.

The surface of the rotatable photosensitive member 7 after the transfer of the toner image to the sheet is cleaned by a residual contaminant such as any untransferred toner being removed by a cleaning device 14, and is respectively used for image formation.

In the apparatus according to the present embodiment, four process devices, i.e., the photosensitive drum 7, the charging roller 11, the developing device 10 and the cleaning device 14 are made into a cartridge so as to be collectively mountable and detachable by the openable and closable lid of the apparatus being opened.

Heat fixing means 15 in the present embodiment is of a film heating type, and the reference character 15*a* designates a heater holding frame, the reference character 15*b* denotes a heater held on the underside of this heater holding frame, the reference character 15*c* designates cylindrical heat-resistant film loosely fitted onto the heater holding frame 15*a* including the heater 15*b*, and the reference numeral 16 denotes a pressure roller brought into pressure contact with the underside of the heater 15*b* with the film 15*c* interposed therebetween.

When the pressure roller 16 is rotatively driven in the conveyance direction of the sheet, the cylindrical heat-resistant film 15*c* is driven to rotate around the heater holding frame 15*a* while the inner surface side thereof is sliding in close contact with the underside of the heater 15*b*.

The sheet S having received the transfer of the toner image is introduced into between the film 15*c* and the pressure roller 16 in the above-described pressure contact portion, whereby the heat of the heater 15*b* is imparted to the sheet through the film 15*c* and the heat fixing of the toner image is done.

A CPU 121 for effecting the general control of a printer main body is provided, and in the present embodiment, it effects the control of the temperature of the fixing device and the process speed of the main body on the basis of the sheet size recognized by the sheet width size detecting means 20.

When in this laser beam printer, the sheet width size detecting means 20 recognizes the conveyed sheet as the large size sheet S2, the CPU sets the controlled temperature of the fixing device at 165° C. as a "large size mode", and controls the process speed so as to be 14 ppm. Also, when the sheet width size detecting means 20 recognizes the conveyed sheet as the small size sheet S1, the CPU sets the controlled temperature of the fixing device at 150° C. as a "small size mode", and controls the process speed so as to be 10 ppm.

According to the above-descried control, even in a rare case where the small size sheet S1 is passed with the end portion reference with the sheet width regulating guides 2 remaining positioned at a large size width (FIG. 11), the sheet width size detecting means 20 reliably recognizes the sheet as the small size sheet S1, whereby the CPU 121 can reliably effect the control of the "small size mode" to the controlled temperature of the fixing device and the process speed. Thereby, the image problems such as the "phenomenon of the temperature rise of the non-sheet passing portion" and the "high temperature offset" which have heretofore posed problems and further, the damage of the fixing device and the trouble of the main body can be prevented.

As described above, the image forming apparatus is provided with the sheet width size detecting means 20 having the construction of the present embodiment, whereby even if the user passes a small size sheet from anywhere in the conveyance width direction, the sheet can be reliably recognized as the small size sheet. Further, on the basis of this detection, the temperature control of the fixing device or the process speed of the main body is made proper, whereby the printing of a good quality of image can always be effected by a simple and low-cost construction. Also, when the conveyed sheet is of a large size, the controlled temperature is made high and sheet passing is effected at the highest possible speed, and when the width of the conveyed sheet is a small size, the controlled temperature is made low or the process speed is made low, whereby the image problems such as the "phenomenon of the temperature rise of the non-sheet passing portion" and "high temperature offset" of the fixing device and further, the damage of the fixing device and the trouble of the main body resulting from the excessive temperature rise of the non-sheet passing portion can be prevented.

Second Embodiment

A sheet size detecting apparatus according to the present embodiment differs from first Embodiment in that each of the first arm and the second arm has a sensor flag (actuator portion).

Figure 14:
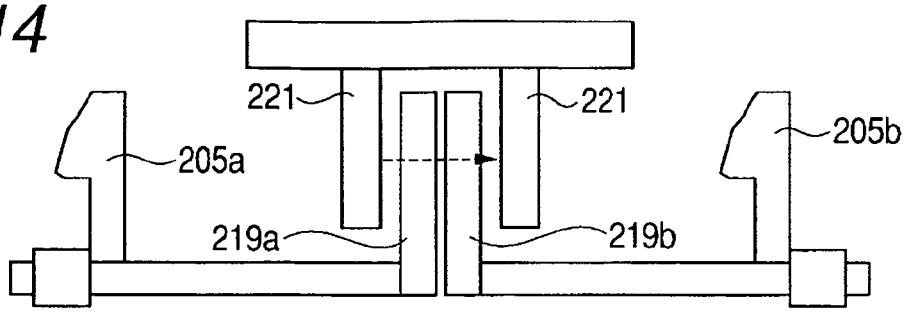
FIG. 14 is a front view of a sheet size detecting apparatus according to second Embodiment.

FIG. 14 is a front view of the sheet size detecting apparatus according to the present embodiment. A first arm 205*a* with which a recording material (sheet) contacts and a first sensor flag (first actuator portion) 219*a* form a part, and a second arm 205*b* with which the recording material contacts and a second sensor flag (second actuator portion) 219*b* form a part. The first sensor flag 219*a* is movable to a position for intercepting the optical path between the light emitting portion and light receiving portion of a photointerrupter (sensor) 221 and a position retracted from the optical path by the first arm 205*a* fixing pivotally moved. Likewise, the second sensor flag 219*b* is movable to a position for intercepting the optical path between the light emitting portion and light receiving portion of the photointerrupter (sensor) 221 and a position retracted from the optical path by the second arm 205*b* being pivotally moved.

Figure 15:
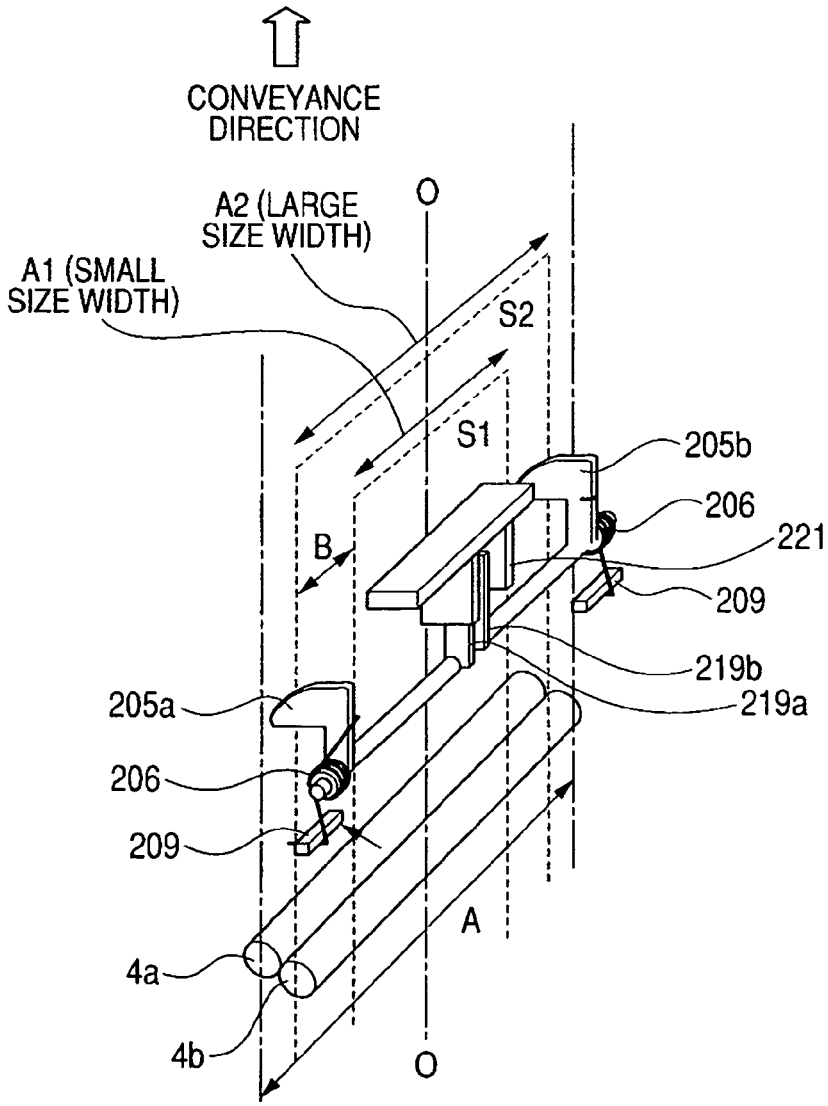
FIG. 15 is a perspective view showing the positional relations between sheet sizes and first and second arms of the sheet size detecting apparatus.

FIG. 15 is a perspective view showing the positional relations among the small size recording material S1, the large size recording material S2 and the first and second arms when the sheet is passed so that the conveyance reference O-O and the center of the sheet in the width direction thereof (direction orthogonal to the conveyance direction) may coincide with each other. A1 designates a conveyance width area for the small size sheet S1 in the sheet conveying path A, A2 denotes a conveyance width area for the large size sheet S2, and B designates the difference area between the conveyance width areas A1 and A2 for the small size sheet S1 and the large size sheet S2. The first and second arms 205*a* and 205*b* are kept in such a rotation angle posture (home position) state as shown in FIG. 15 by springs 206 and stoppers 209. When the sheet is conveyed to the areas of the arms 205*a* and 205*b*, the sheet brings down the sensors 205*a* and 205*b* from below them, whereby the sensor flags integral with the arms are also rotated. By the sheet passing being finished, design is made such that the arms are returned to the position of FIG. 15 by the forces of the springs 206.

Accordingly, when at least one of the first sensor flag 219*a* and the second sensor flag 219*b* is located at the home position, the optical path between the light emitting portion and light receiving portion of the photointerrupter 221 is intercepted.

Figure 16:
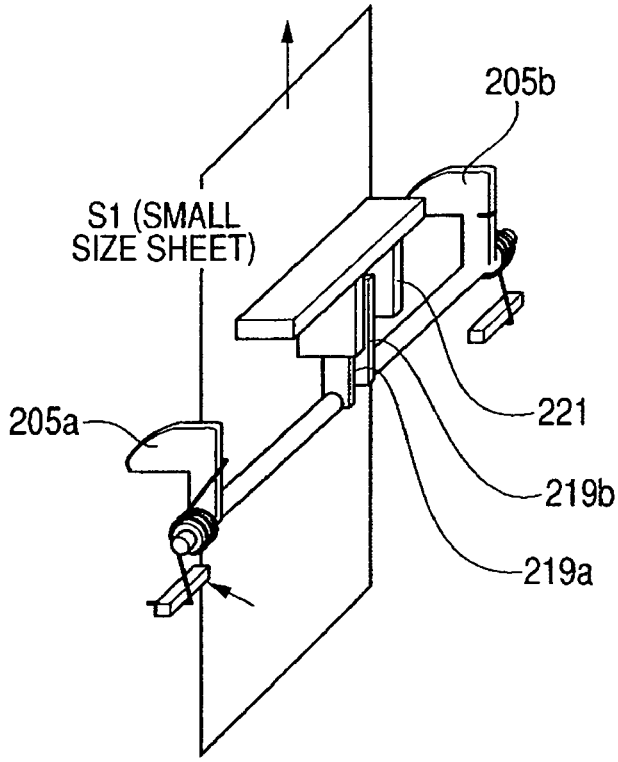
FIG. 16 is a perspective view showing the states of the first and second arms when a small size sheet has been passed with the center reference.

Thus, when the sheet passed to the conveying path A of FIG. 15 with the conveyance reference O-O as the reference is the small size sheet S1, the sheet contacts with neither of the sensor arms 205*a* and 205*b*, as shown in FIG. 16. Therefore, the sensor arms are not rotated and the optical path of the photointerrupter 221 is intercepted by both of the first sensor flag 219*a* and the second sensor flag 219*b*.

Figure 17:
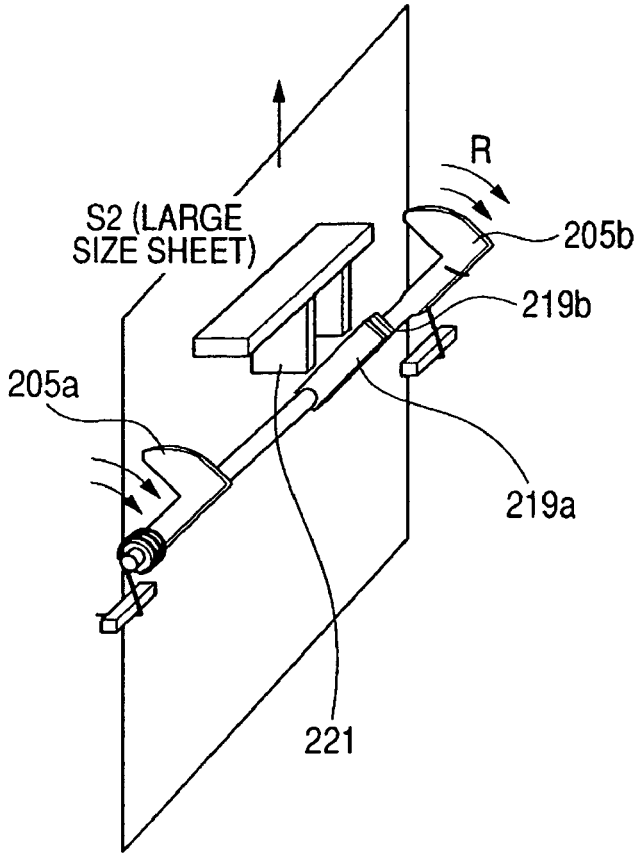
FIG. 17 is a perspective view showing the movement of the first and second arms when a large size sheet has been passed.

When the sheet passed to the conveying path A is the large size sheet S2, the leading edge of the sheet S2 contacts both of the sensor arms 205*a* and 205*b*, as shown in FIG. 17. Therefore, the sensor arms 205*a* and 205*b* are pivotally moved in the direction of arrow R, and the first sensor flag 219*a* and the second sensor flag 219*b* are both refracted from the optical path of the photointerrupter 221.

Description will now be made of a case where the sheet passed to the conveying path A is the small size sheet S1 and is conveyed in a state in which the conveyance reference O-O and the center of the sheet in the width direction thereof (direction orthogonal to the conveyance direction) do not coincide with each other.

Figure 18:
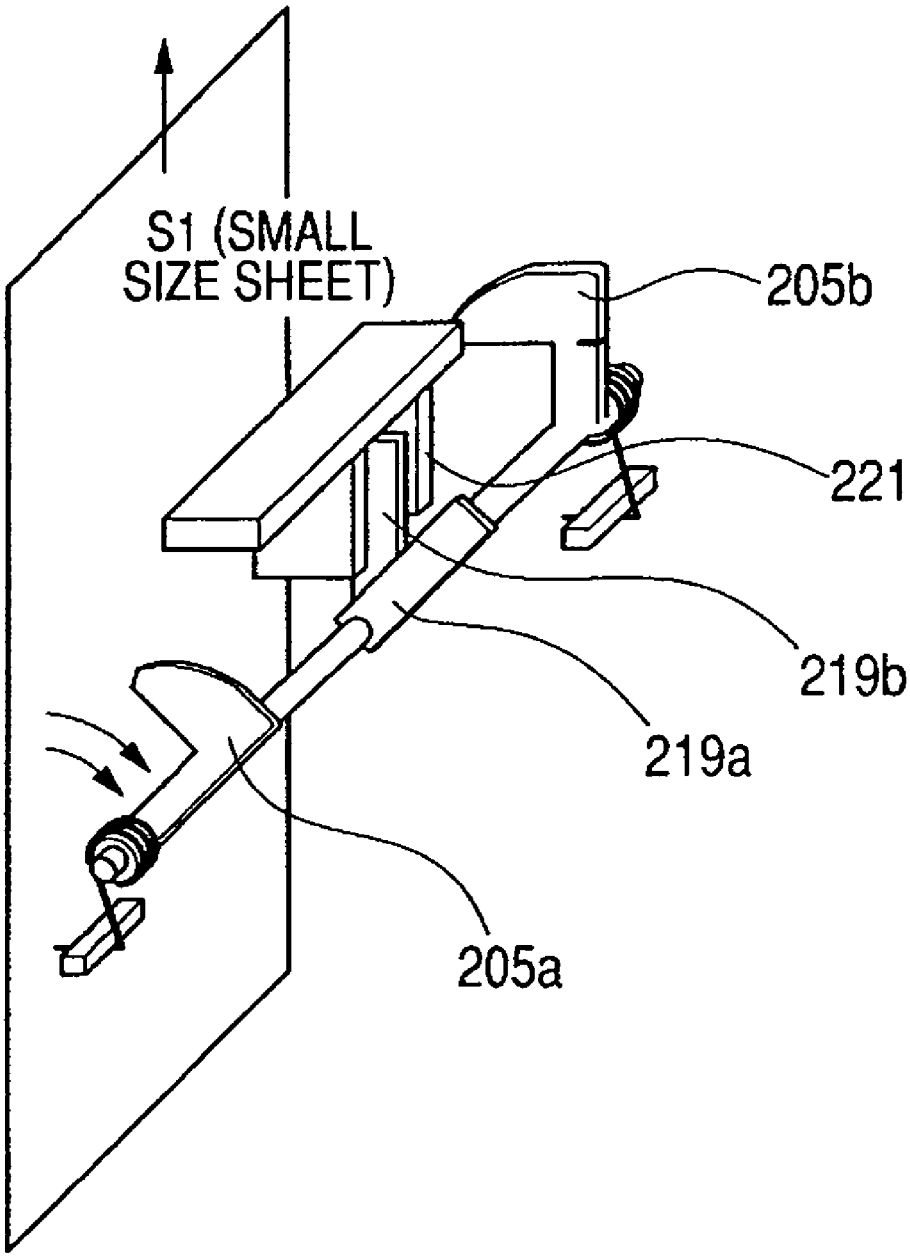
FIG. 18 is a perspective view showing the movement of the first and second arms when a small size sheet has been passed with the end portion reference.

In this case, even if as shown in FIG. 18, the sheet brings down the first arm 205*a* and rotates the first sensor flag 219*a*, the second flag sensor flag 219*b* remains left in the optical path of the photointerrupter 221. Consequently, the output level of the photointerrupter 221 becomes the same as that in the case of FIG. 16.

Table 2 below shows four detection patterns conceivable in the present embodiment. In Table 2, "home position" indicates a state in which the arms are not rotated, and "rotation" indicates a state in which the arms are rotated. Also, "close" indicates a state in which the optical path of the photointerrupter 221 is intercepted by at least one of the first sensor flag 219*a* and the second sensor flag 219*b*, and "open" indicates a state in which the optical path of the photointerrupter 221 is intercepted by neither of the first sensor flag 219*a* and the second sensor flag 219*b*.

TABLE 2

| detection pattern | 1st arm 205a | 2nd arm 205b | output of photointerrupter 221 | result of size judgment |
|---|---|---|---|---|
| 1 | home position | home position | Low (close) | small size |
| 2 | home position | rotation | Low (close) | small size |
| 3 | rotation | home position | Low (close) | small size |
| 4 | rotation | rotation | High (open) | large size |

As noted above, again in the case of the present embodiment, as in first Embodiment, the output level (Low) of the sensor 221 when only one of the first arm 205*a* and the second arm 205*b* has been moved (detection patterns 2 and 3) is the same as the output level (Low) thereof when neither of the first arm 205*a* and the second arm 205*b* is moved (detection pattern 1), and the output level (High) of the sensor 221 when both of the first arm 205*a* and the second arm 205*b* have been moved (detection pattern 4) differs from the output level (Low) thereof when neither of the first arm 205*a* and the second arm 205*b* is moved (detection pattern 1).

Accordingly, again in the present embodiment even in a rare case where the small size sheet is passed with the spacing between the regulating guides 2 made equal to the width of the large size sheet, the sheet width size can be recognized as the small size sheet S1 without the number of sensors such as costly photointerrupters being increased.

Third Embodiment

Figure 19:
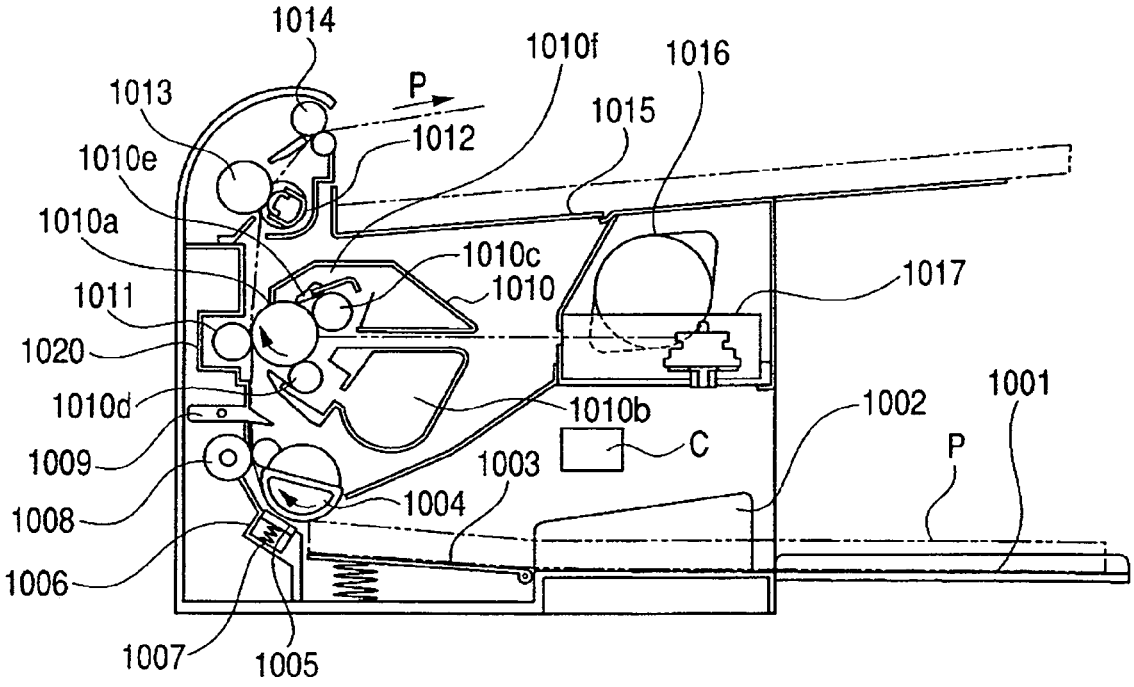
FIG. 19 is a schematic cross-sectional view showing an image forming apparatus carrying thereon a sheet size detecting apparatus according to third Embodiment.

FIG. 19 is a schematic cross-sectional view showing a laser printer as an example of an image forming apparatus carrying thereon a sheet size detecting apparatus according to third Embodiment of the present invention. The basic construction of the sheet size detecting apparatus according to the present embodiment is substantially the same as that of first Embodiment, and differs from the latter in that a sheet discharge detecting mechanism is provided near a location at which a sheet size detecting mechanism is disposed. FIG. 19 shows the state when a recording material (sheet) is being conveyed. In this image forming apparatus, there is adopted an electrophotographic printing method of scanning a photosensitive drum 1010*a* as an image bearing member by a laser beam to thereby form an image on the photosensitive drum 1010*a*.

Description will now be made of the epitome of the operation of the laser printer according to the present embodiment.

A sheet P is placed on an openable and closable feeding tray 1001 and a feeding plate 1003, and has its sheet width direction substantially orthogonal to the conveyance direction of the sheet P guided by a sheet width regulating plate 1002.

After an operator (user) has set the sheet P in a feeding port, a motor 1016 starts to rotate by the print starting signal of a controlling portion (CPU). The motor 1016 drives a feeding roller 1004, conveying rollers 1008, the photosensitive drum 1010*a* carried in a toner cartridge 1010, a fixing pressure roller 1013 and discharging rollers 1014 in the sheet conveyance direction (the direction of arrow P). The feeding roller 1004 as a sheet feeding portion receives a feed starting signal from a control substrate, not shown, by the controlling portion C, and thereafter makes one full rotation to thereby feed the sheet P in the direction of arrow.

The feeding operation will now be described.

When with the feed starting signal as a trigger, the feeding roller 1004 is rotated in the direction of arrow, a feeding cam, not shown, provided coaxially with the feeding roller 1004 is also rotated, and the feeding plate 1003 operatively associated with the feeding cam is pivotally moved to thereby urge the sheet P against the feeding roller. Then, by the friction between the feeding roller 1004 and the sheet P, the feeding roller 1004 feeds the sheet P.

On the other hand, in a separating pad holder 1006, there are provided a separating pad spring 1007 and a separating pad 1005 pressurized by the separating pad spring 1007. Simultaneously with the rotation of the feeding roller 1004, sheets P are separated and fed one by one from a bundle of sheets P by the separating pad 1005. Immediately before the completion of one full rotation of the feeding roller 1004, the feeding cam, not shown, provided coaxially with the feeding roller 1004 again depresses the feeding plate 1003 to a feed standby position.

Description will now be made of an image forming process by an image forming portion.

The sheet P fed by the one full rotation of the feeding roller 1004 is conveyed by the conveying rollers 1008, and brings down a sheet leading edge detecting flag 1009. A photosensor, not shown, is attached to the sheet leading edge detecting flag 1009, and by the sheet leading edge detecting flag 1009 being pivotally moved, the photosensor detects the leading edge position of the sheet P, and after a predetermined time, a laser exposing apparatus 1017 applies a laser beam to the photosensitive drum 1010*a*.

The photosensitive drum 1010*a* is rotated in the direction of arrow indicated in FIG. 19, and is uniformly charged by a charging roller 10*c* supplied with electric power from a high voltage source, not shown. An electrostatic latent image is formed on the photosensitive drum 1010*a* by the laser beam emitted from the laser exposing apparatus 1017.

A toner container 1010*b* is filled with a toner, and with the rotation of a developing sleeve 1010*d*, a suitable amount of toner is subjected to moderate charging and is thereafter supplied onto the photosensitive drum 1010*a*. The toner on the developing sleeve 1010*d* adheres to the electrostatic latent image on the photosensitive drum 1010*a*, whereby the latent image is developed and visualized as a toner image. The visualized toner image on the photosensitive drum 1010*a* is transferred onto the sheet P by a transfer roller 1011. Any untransferred toner not transferred but residual on the photosensitive drum 1010*a* is collected into a waste toner container

1010*f* by a cleaning blade 1010*e*, and the photosensitive drum 1010*a* having had its surface thus cleaned repetitively enters the next image forming process.

The sheet P having the toner image formed thereon is subjected to heating and pressurization by a fixing portion (fixing device) constituted by a fixing and heating member 1012 and a fixing pressure roller 1013, and the toner image is permanently fixed on the sheet P. Thereafter, the sheet P having the toner image fixed thereon is discharged out of the apparatus by the discharging rollers 1014, and is stacked on a discharging tray 1015.

Detailed description will now be made of the sheet discharging portion of the printer having mounted thereon a sheet size detecting mechanism (sheet size detecting apparatus) and a sheet discharge detecting mechanism.

Figure 20:
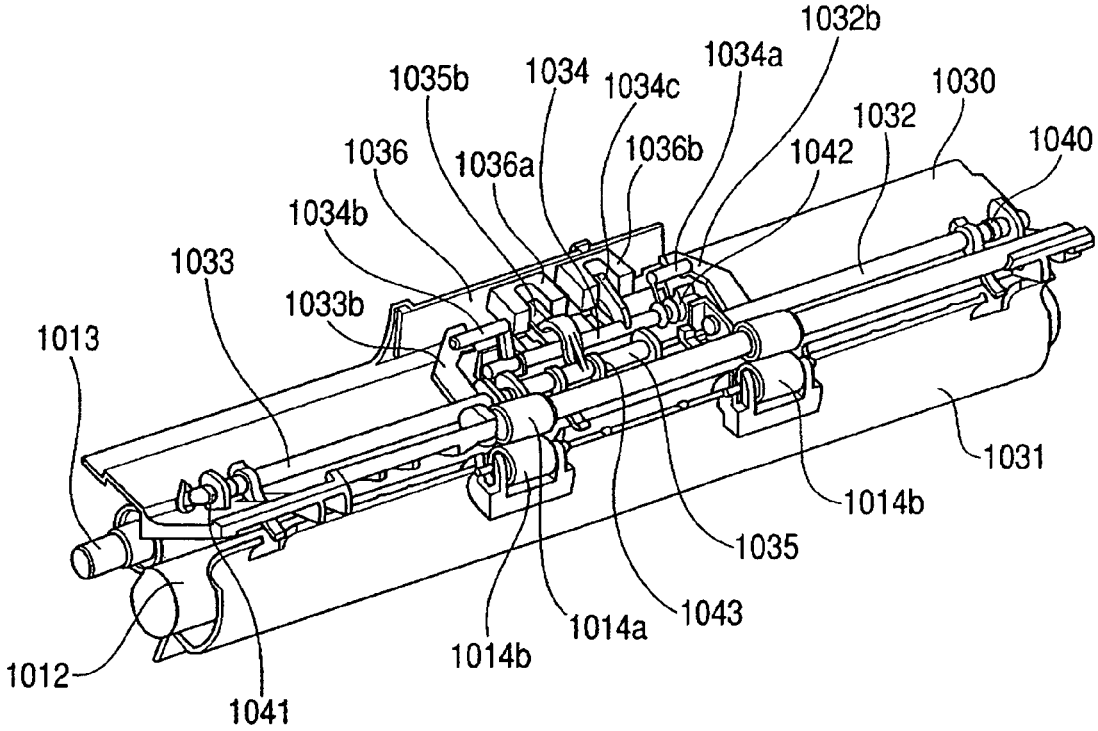
FIG. 20 is a schematic perspective view showing the discharging portion of the image forming apparatus carrying thereon the sheet size detecting apparatus according to third Embodiment.

FIG. 20 is a schematic perspective view showing the discharging portion in the present embodiment.

A discharge upper guide 1030 and a discharge lower guide 1031 are disposed so as to surround the heating and fixing member 1012 and the fixing pressure roller 1013. Also, the discharge upper guide 1030 and the discharge lower guide 1031 together constitute a guide portion for guiding the sheet toward the discharging tray 1015. A pair of discharging rollers 1014*a* are rotatably journalled on the discharge upper guide 1030, and a pair of discharging runners 1014*b* are rotatably journalled on the discharge lower guide 1031, and the discharging runners 1014*b* are pressed toward the discharging rollers 1014*a* by pressure springs.

Also, a first arm 1032 and a second arm 1033 forming a portion of the sheet size detecting mechanism are rotatably journalled substantially coaxially with each other on the discharge upper guide 1030.

Figure 21A:
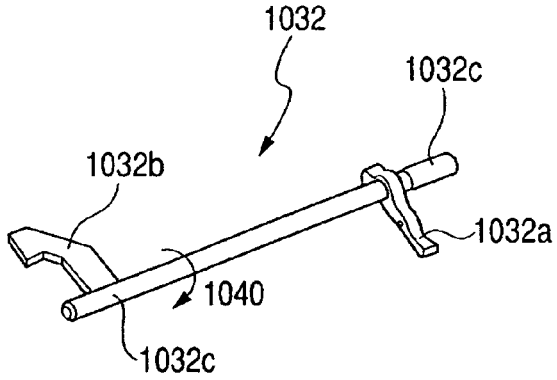
FIGS. 21A, 21B and 21C are exploded views of parts used in the sheet size detecting apparatus according to third Embodiment.
Figure 21B:
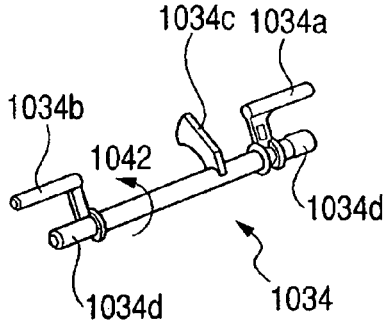

FIG. 21A is a detailed view showing the first arm 1032.

The first arm 1032 is constituted by a first contact portion 1032*a* with which the sheet contacts, a first supporting portion 1032*b* for regulating the pivotal movement of a sensor link (actuator) 1034 which will be described later, and a first shaft portion 1032*c* providing a rotary shaft. The shape of the second arm 1033 in the present embodiment is symmetrical with respect to the first arm 1032. Accordingly, it is to be understood that the second arm 1033, like the first arm 1032, is constituted by a second contact portion 1033*a*, a second supporting portion 1033*b* and a second shaft portion 1033*c*. However, it need not always be of a symmetrical shape.

The first and second contact portions 1032*a* and 1033*a* of the first arm 1032 and the second arm 1033, respectively, are disposed at locations substantially symmetrical with respect to the center of a sheet conveying path in the width direction thereof. The disposition locations of the first and second contact portion 1032*a* and 1033*a* (the distance between the first contact portion 1032*a* and the second contact portion 1033*a*) may suitably be set by the characteristic of the fixing portion of the image forming apparatus on which the recording material size detecting apparatus of the present invention is mounted.

Description will now be made of the sensor link (actuator) 1034 acting on a photointerrupter (sensor) 1036*b* for recording material size detection. The sensor link 1034 is rotatably journalled on the discharge upper guide 1030. The 21B is a detailed view of the sensor link 1034.

The sensor link 1034 is constituted by a first supported portion 1034*a* supported by the first supporting portion 1032*b* of the first arm 1032, a second supported portion 1034*b* supported by the second supporting portion 1033*b* of the second arm 1033, a flag portion 1034*c* for intercepting the optically path between the light emitting portion and light receiving portion of the photointerrupter 1036*b*, and a third shaft portion 1034*d*. Also, the third shaft portion 1034*d* of the sensor link 1034 is disposed more toward the photointerrupter 1036*b* than an imaginary axis linking the first shaft portion 1032*c* of the first arm 1032 and the second shaft portion 1033*c* of the second arm 1033 together.

Figure 21C:
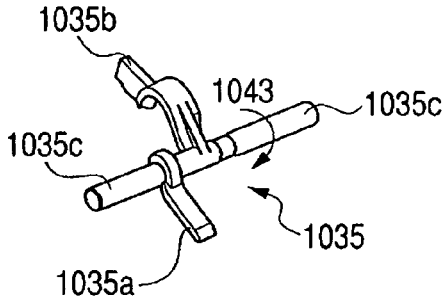

Also, a sensor link (center arm) 1035 for detecting the discharge of sheets of all sizes passed to the printer is pivotally movably journalled on the discharge upper guide 1030. A detailed view of the sensor link 1035 is shown in FIG. 21C.

The sensor link 1035 is constituted by a contact portion 1035*a* with which the sheet contacts, a flag portion (actuator portion) 1035*b* for intercepting the optical path between the light emitting portion and light receiving portion of a photointerrupter 1036*a* for sheet discharge detection, and a shaft portion 1035*c*. The shaft portion 1035*c* is disposed on an imaginary axis linking the first shaft portion 1032*c* of the first arm 1032 and the second shaft portion 1033*c* of the second arm 1033. By a construction in which the three shaft portions (1032*c*, 1033*c* and 1035*c*) are disposed substantially coaxially with one another, it is possible to compactly arrange the two detecting mechanisms, i.e., the sheet size detecting mechanism and the sheet discharge detecting mechanism in a small space. The contact portion 1035*a* is provided at a location with which sheets of all sizes applicable (conveyable on the sheet conveying route) to the laser printer according to the present embodiment. In the present embodiment, it is provided substantially at the center of the sheet conveying route in the width direction thereof.

Also, the two photointerrupter 1036*a* and 1036*b* are mounted on a sensor substrate 1036 fixed to the discharge upper guide 1030. The sensor substrate 1036 fixed to the discharge upper guide 1030. The sensor substrate 1036 is connected to the controlling portion C of the image forming apparatus through a cable, not shown, and the detection signals of the photointerrupters 1036*a* and 1036*b* are processed by the controlling portion C.

Also, torsion springs 1040, 1041, 1042 and 1043 as biasing means are disposed on the first arm 1032, the second arm 1033, the sensor link 1034 and the second link 1035, respectively.

The operations of the first arm 1032, the second arm 1033 and the sensor link 1034 forming a portion of the sheet size detecting mechanism will now be described with reference to Table 3 below and FIGS. 22A and 22B.

Figure 22A:
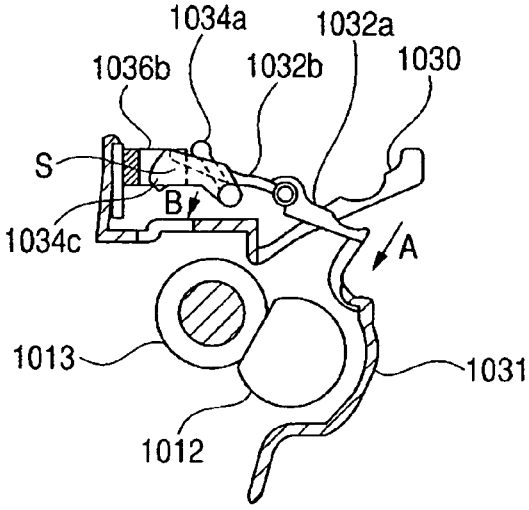
FIGS. 22A and 22B are schematic cross-sectional views showing the movement of an arm and an actuator in third Embodiment.

FIG. 22A is a schematic cross-sectional view showing the sensor standby state (home position) of the fixing and discharging portion in FIG. 20.

As already described with reference to FIG. 20, the supported portion 1034*a* (1034*b*) of the sensor link 1034 is disposed above the supporting portion 1032*b* (1033*b*) of the first arm 1032 (the second arm 1033). Also, the first arm 1032 is biased in the direction of arrow A in FIG. 22A about the first shaft portion 1032*c* by the action of the torsion spring 1040. Also, the sensor link 1034 is biased in the direction of arrow B in FIG. 22A about the third shaft portion 1034*d* by the action of the torsion spring 1042.

Also, in the sensor standby state, the photointerrupter 1036*b* is light-intercepted (hereinafter referred to as Close) by the flag portion 1034*c* of the sensor link 1034.

When the moments generated by the torsion springs 1040, 1041 and 1042 are defined as P40, P41 and P42 are defined as P40, P41 and P42, respectively, the torsion springs 1040, 1041 and 1042 are set so that P40 (=P41)>P42. Even if the sheet contacts with only one of the first are 1032 and the second arm 1033, the sensor link 1034 maintains the standby state.

Figure 22B:
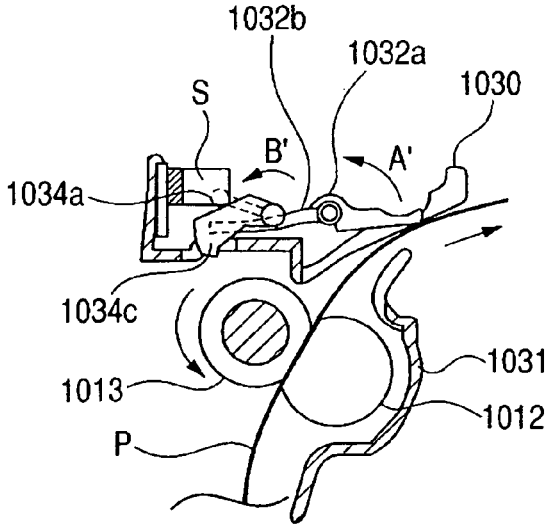

FIG. 22B is a schematic cross-sectional view showing the state when a sheet P of a large size astride both of the contact portion 1032*a* of the first arm 1032 and the contact portion 1033*a* of the second arm 1033 passes.

As shown in FIG. 22B, the sheet contacts with both of the first arm 1032 and the second arm 1033, whereby only when both of the first arm 1032 and the second arm 1033 are rotated in the direction of arrow A', the sensor link 1034 is rotated in the direction of arrow B' from the standby state. Since both of the first arm 1032 and the second arm 1033 are rotated in the direction of arrow A', the sensor link 1034 having its pivotal movement regulated by the first supporting portion 1032*b* and the second supporting portion 1033*b* is also rotated in the direction of arrow B'. When it has been rotated by a predetermined amount (α°), the photointerrupter 1036*b* changes from "Close" to "Open". FIG. 22B shows the Open State.

Also, Table 3 below shows the ON (sheet in contact) and OFF (sheet in non-contact) of the first arm 1032 and the second arm 1033, the state (Open/Close) of the photointerrupter 1036*b* and the ten judgment (small size/large size) of the sheet size. The judgment of the sheet size is effected by the controlling portion C. Here, the controlling portion C constitutes calculating means for obtaining information regarding means for obtaining information regarding the sheet size from the sheet size detecting apparatus and calculating the sheet size.

TABLE 3

| detection pattern | 1st arm 1032 | 2nd arm 1033 | photointerrupter 1036b | judgment of sheet size |
|---|---|---|---|---|
| 1 | OFF | OFF | Close | small size |
| 2 | OFF | ON | Close | small size |
| 3 | ON | OFF | Close | small size |
| 4 | ON | ON | Open | large size |

As shown in Table 3, in the case of the present embodiment, the output level of the photointerrupter 1036*b* when only one of the first arm 1032 and the second arm 1033 has been moved (detection patterns 2 and 3) is the same as the output level thereof when neither of the first arm 1032 and the second arm 1033 is moved (detection pattern 1), and the output level of the photointerrupter 1036*b* when both of the first arm 1032 and the second arm 1033 have been moved (detection pattern 4) differs from the output level thereof when neither of the first arm 1032 and the second arm 1033 is moved (detection pattern 1).

Also, the sensor link (actuator) 1034 is designed to be not moved when one of the first arm 1032 and the second arm 1033 is moved by the contact of the sheet therewith (detection patterns 2 and 3), and to be moved when both of the first arm 1032 and the second arm 1033 are moved by the contact of the sheet therewith (detection pattern 4).

Accordingly, in the present embodiment, even in a rare case where a small size sheet is passed with the spacing between the regulating guides 2 made equal to the width of the large size sheet, the sheet width size can be recognized as the small size sheet without the number of sensors such as costly photointerrupters being increased.

In the present embodiment, when the first arm 1032 and the second arm 1033 are both rotated by 7.2°, the sensor link 1034 can be rotated by 15.5°, and it is possible to improve the rotation sensitivity of the sensor by about twofold. Also, by improving the rotation sensitivity, it is possible to give prolixity to the irregularity of parts in the sensor light-intercepting portion.

While in the present embodiment, the torsion springs are used as the biasing means for biasing the first arm 1032, the second arm 1033 and the sensor link, use may of course be made of other biasing means such as leaf springs, compression springs or tension springs. For example, use may be made of biasing means provided with a ballast shape on the first arm or the second arm itself and utilizing gravity.

Figure 28:
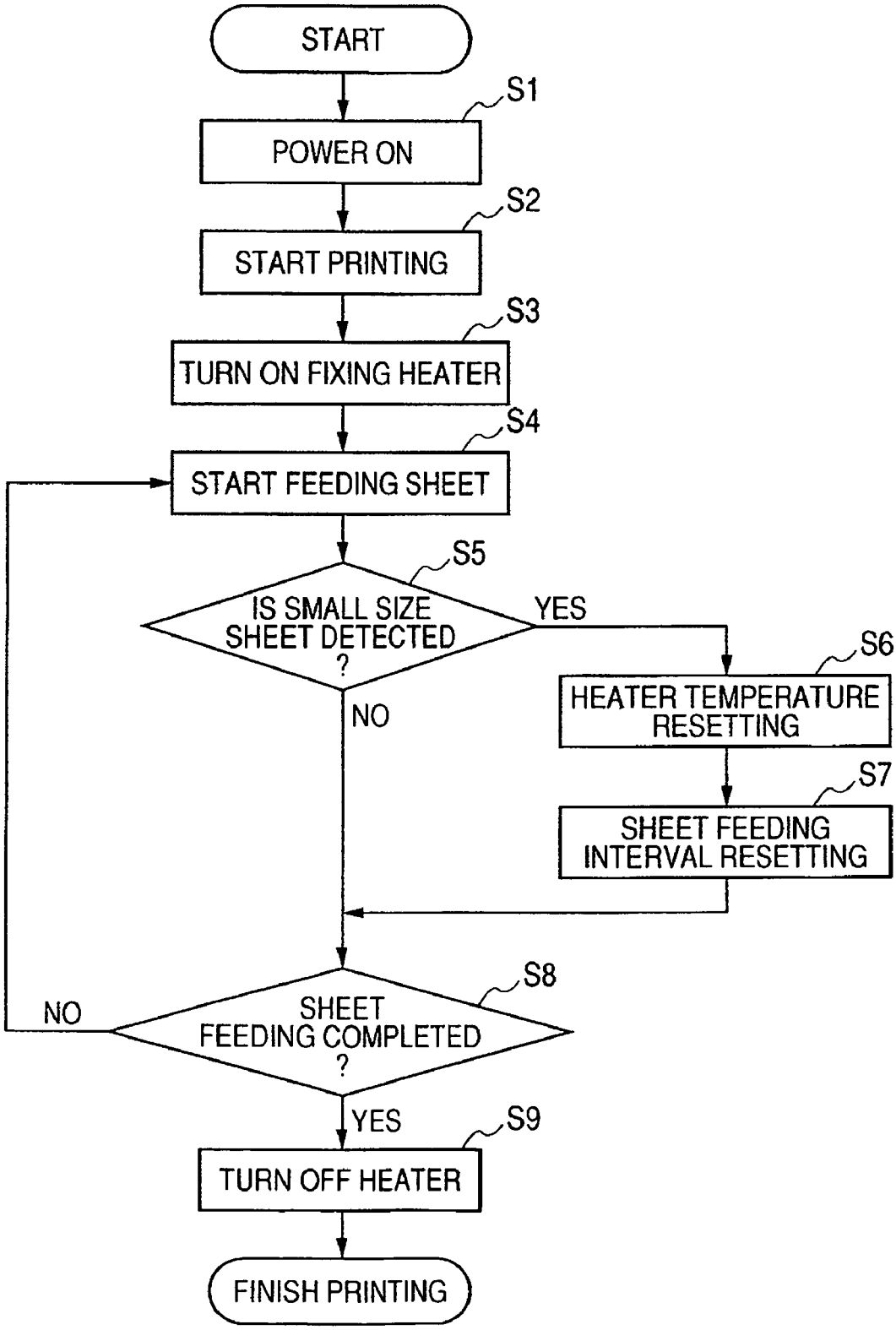
FIG. 28 is a control flow chart of the fixing portion of the image forming apparatus carrying thereon the sheet size detecting apparatus according to third Embodiment.

FIG. 28 is a flow chart of the fixing process executed by the controlling portion C. FIG. 28 will hereinafter be described.

At a step S1, a power supply is switched on. At the next step S2, print is started by instructions from the operator. At the next step S3, the fixing heater is turned on. At the next step S4, sheet supply (sheet feeding) is started.

At the next step S5, the detection of the sheet size using the sheet size detecting apparatus according to the present embodiment is effected. If at the step S5, the sheet size is judged to be a small size, advance is made to a step S6, and if the sheet size is judged to be a large size, advance is made to a step S8.

At a step S6, the control target temperature of the fixing heater is reset by the controlling portion C. At the next step S7, a sheet supplying (feeding) interval is reset by the controlling portion C.

Here, the controlling portion C has the temperature adjusting function of adjusting the temperature of the fixing portion, and the timing adjusting function of adjusting the supply timing of the sheet supplying portion. The controlling portion C effects the control of lowering the control target temperature of the fixing portion, or reducing the sheet supply amount per unit time by timing adjusting means when the sheet size is smaller than a predetermined width.

At the step S8, whether the sheet supply has been competed is judged. If at the step S8, it is judged that the sheet supply has been completed, advance is made to a step S9. If at the step S8, it is judged that the sheet supply is not completed, return is made to the step S4. At the step S9, the fixing heater is turned off, whereafter the printing operation is finished.

As described above, according to the present embodiment, even when a sheet of a small size is passed while being put aside, the detection of the small size becomes possible without the number of sensors such as photointerrupters being increased.

Also, by the positions of the centers of pivotal movement of the first arm 1032 and the second arm 1033 being made substantially coaxial with each other, the movement loci of the contact portions 1032*a* and 1033*a* when these contact portions contact with the sheet can be made the same, and it becomes possible to make a load applied to the leading edge portion of the sheet uniform. Accordingly, it becomes possible to prevent jam or skew feeding during the conveyance of the sheet.

Also, by the pivot shafts of the first arm 1032 and the second arm 1033 and the pivot shaft of the sensor link 1034 being deviated from each other, the rotation angle of the sensor link 1034 can be made greater than the rotation angles of the first arm 1032 and the second arm 1033. Therefore, the sheet detection sensitivity can be improved without the sheet size detection apparatus being made bulky.

Also, by using a photointerrupter as detecting means, it is possible to construct the apparatus more inexpensively. Here, a switch (e.g. a microswitch) may be used as the detecting means. In this case, the electric circuit of the detecting portion can be simplified. Also, a magnetic sensor may be used as the detecting means. In this case, a frictional contact portion is absent on the sensor itself and therefore, it becomes possible to provide an apparatus excellent in durability. When a switch or a magnetic sensor is used as the detecting means, a switch pushing portion or a magnetic portion for operating these is provided on an actuator.

Also, by constructing the apparatus as in the present embodiment, it is possible to dispose a plurality of sensors in the same cross section (in the same area when a cross section is taken in the sheet conveyance direction), and it is possible to realize an improvement in space efficiency in a compact apparatus. It also becomes possible to dispose a plurality of sensors on the same substrate, and this in turn reads to a lower cost.

Also, by making the arms 1032 and 1033 and the sensor link 1034 into a sliding type, it is possible to downsize a height direction relative to a sheet conveying surface (conveying route), and this is particularly effective to manufacture a thin type apparatus.

Further, the fixing temperature and the sheet supply (sheet passing) timing are controlled by the use of the information of the detecting means, whereby even when the sheet passing position is disturbed, it becomes possible to maintain a fixing property, and it becomes possible to provide stable images of high quality.

Also, the controlling portion C may preferably constitute setting means, checking-up means and transmitting means. The setting means is means for the operator to set the sheet size. Also, the checking-up means is means for checking up whether the sheet size set by the setting means is the same as the sheet size calculated by the aforementioned calculating means. Also, the transmitting means is means for transmitting the difference in the sheet size to the operator when it has been found that the sheet size set by the setting means differs from the sheet size calculated by the calculating means. Thereby, it becomes possible for the apparatus itself to have the function of self-diagnosing a difference in sheet setting at a low cost, and it becomes possible to early inform the operator of a malfunction to thereby early recover the failure of printing.

Fourth Embodiment

Fourth Embodiment of the present invention will hereinafter be described. In the following description, chiefly differences of the present embodiment from third Embodiment will be described, and constituent portions similar to those in third Embodiment are given the same reference characters and need not be described.

Figure 23:
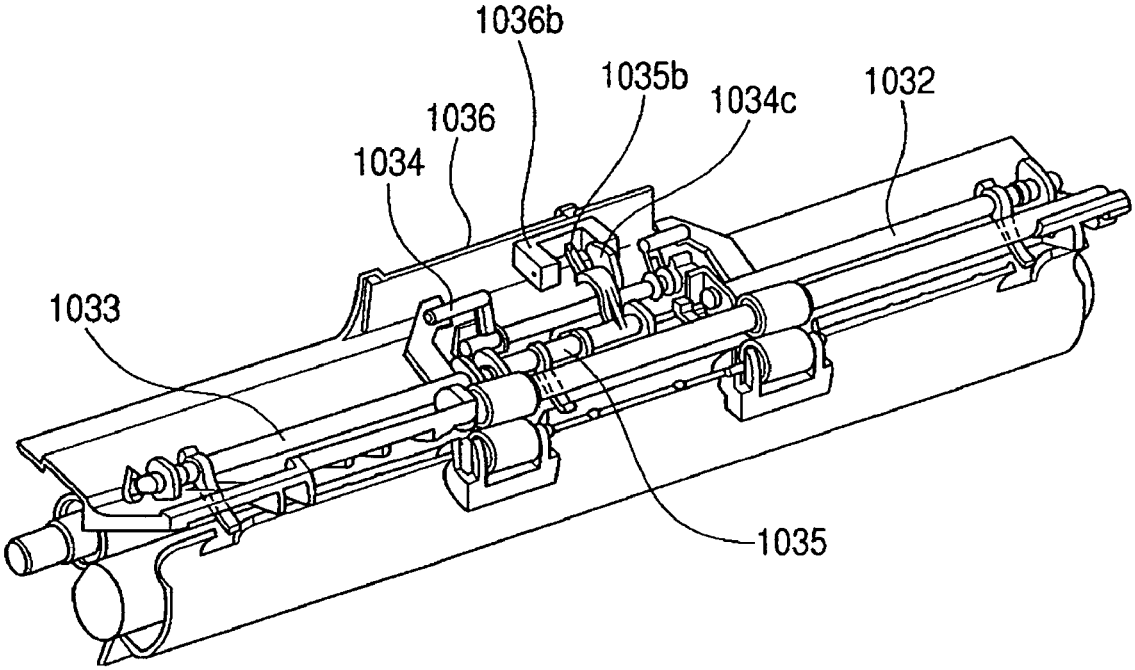
FIG. 23 is a schematic perspective view showing the discharging portion of an image forming apparatus carrying thereon a sheet size detecting apparatus according to fourth Embodiment.

FIG. 23 is a schematic perspective view showing 9 discharging portion in fourth Embodiment of the present invention. In the present embodiment, as shown in FIG. 23, a photointerrupter exclusively for detecting the flag portion (actuator portion) 1035*b* of a sensor link (center arm) 1035 is omitted from on a sensor substrate 1036. This is because a photointerrupter 1036*b* serves to detect a sensor link 1034 and also to detect the sensor link 1035. Therefore, only the photointerrupter 1036*b* is mounted on the sensor substrate 1036.

Figure 24A:
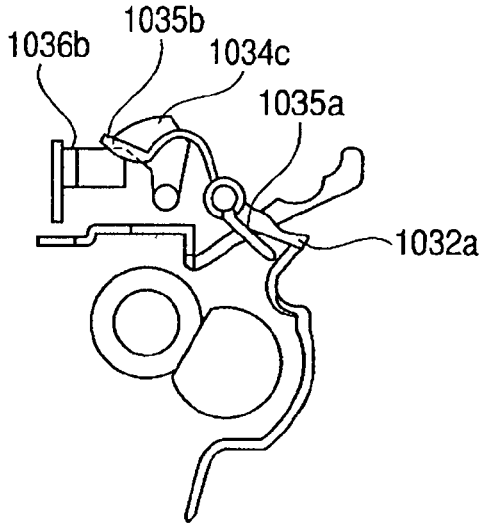
FIGS. 24A, 24B, 24C and 24D are schematic cross-sectional views showing the movement of an arm and an actuator in fourth Embodiment.

FIG. 24A is a schematic cross-sectional view showing the sensor standby state (home position) of a fixing and discharging portion in FIG. 23.

While in third Embodiment, the standby position of the sensor link 1034 and the sensor link 1035 are represented as Close, in fourth Embodiment, it is represented as Open. Also, the location of the contact portion 1035*a* at the home position of the sensor link 1035 is made different from the locations of the contact portions 1032*a* and 1033*a* at the home positions of the first arm 1032 and the second arm 1033 in the sheet conveyance direction. That is, in the present embodiment, the location of the present embodiment, the location of the sensor link 1035 at the home position of the contact portion 1035*a* is provided upstream of the locations of the first and second arms 1032 and 1033 at the home positions of the contact portions 1032*a* and 1033*a* with respect to the sheet conveyance direction.

The epitome of the operation will now be described.

Figure 24B:
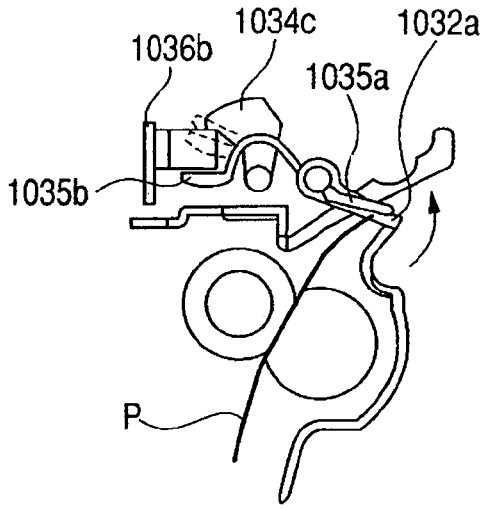

FIGS. 24A, 24B, 24C and 24D are schematic cross-sectional views showing the states when a sheet P of a large size astride both of the contact portion 1032*a* of the first arm 1032 and the contact portion 1033*a* of the second arm 1033 passes. FIG. 14A shows the state before the leading edge of the sheet arrives at the contact portion 1035*a* of the sensor link 1035. FIG. 24B shows the state before the leading edge of the large size sheet contacts with the contact portion 1035*a* of the sensor link 1035, and the leading edge of the large size sheet contacts with the contact portion 1032*a* of the first arm 1032 and the contact portion 1033*a* of the second arm 1033.

The flag portion 1035*b* of the sensor link 1035, unlike third Embodiment, is formed into a thin bar shape, and completely crosses and passes the optical path between the light emitting portion and light receiving portion of the photointerrupter 1036*b* when the sheet P passes. Thus, the output signal of the photointerrupter 1036*b* becomes a pulse wave. In order to detect this pulse wave, the width of the flag portion 1035*b* in the pivotal movement direction thereof is made equal to or greater than the sensor sampling of the controlling portion C and is made sufficient to distinguish it from noise.

Figure 24C:
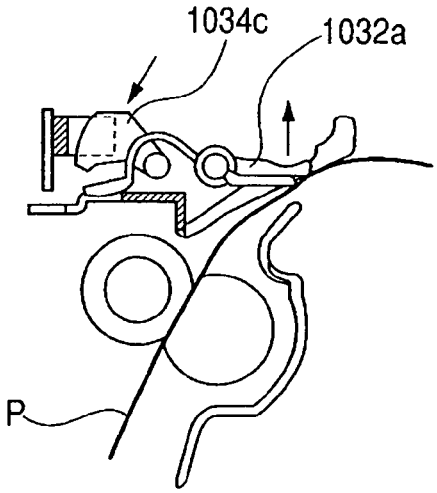

FIG. 24C shows the state when a time has elapsed from the state of FIG. 24B and the leading edge of the sheet has contacted with both of the contact portion 1032*a* of the first arm 1032 and the contact portion 1033*a* of the second arm 1033.

When the sheet P contacts with both of the first and second arms 1032 and 1033, the flag portion 1034*c* of the sensor link 1034 closes the photointerrupter 1036*b*.

Figure 24D:
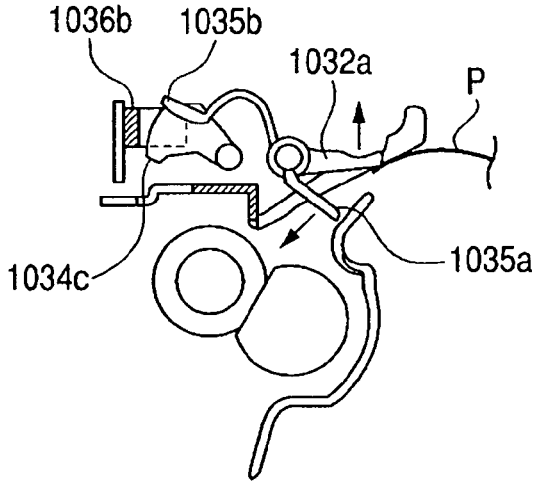

FIG. 24D shows the state immediately after a time has elapsed from the state of FIG. 24C and the trailing edge of the sheet P has passed the contact portion 1035*a* of the sensor link 1035. The flag portion 1035*b* of the sensor link 1035 has been returned to the standby position shown in FIG. 24A, but the contact portion 1032*a* of the first arm 1032 and the contact portion 1033*a* of the second arm 1033 are still contacted with by the sheet. Therefore, the sensor link 1034 is not returned to the standby position and the state of the photointerrupter 1036*b* remains closed.

Figure 25A:
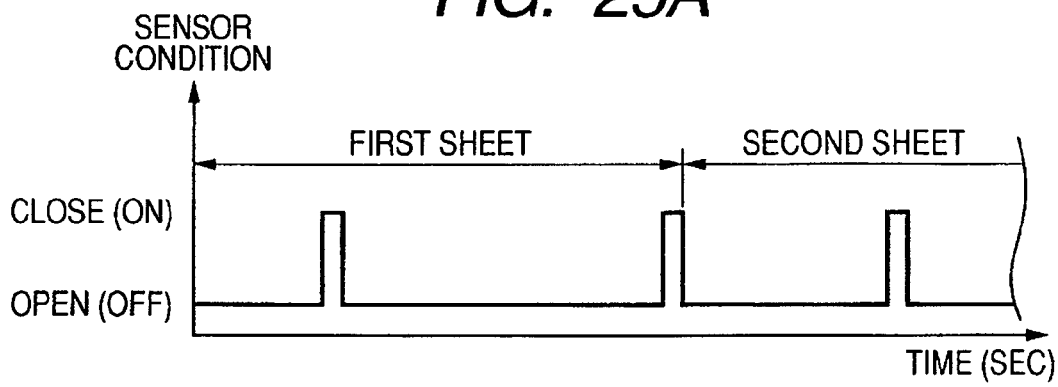
FIGS. 25A, 25B and 25C are time charts showing the output of a sensor in fourth Embodiment.
Figure 25B:
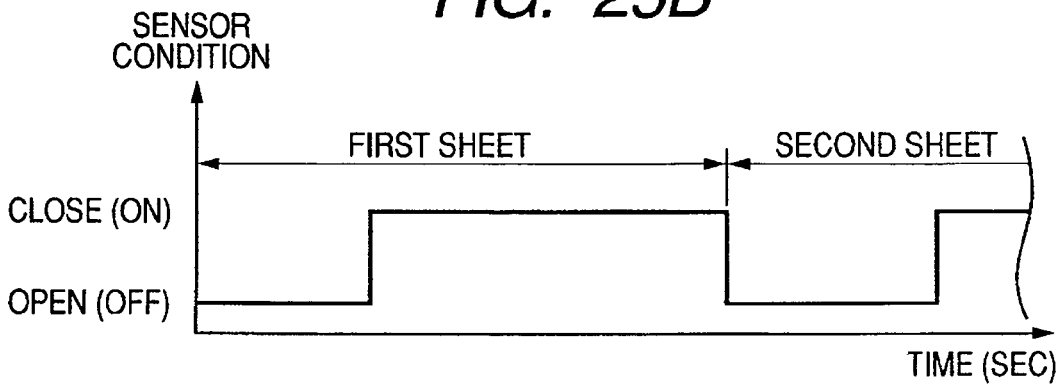
Figure 25C:
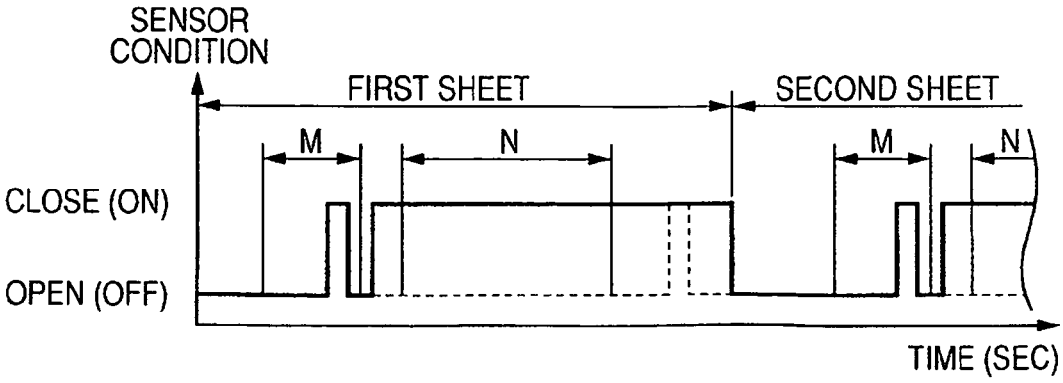

FIGS. 25A, 25B, and 25C show time charts of the respective sensor flags.

FIG. 25A is a time chart of the flag portion 1035*b* of the sensor link 1035. A pulse wave is outputted once by each of the leading edge and trailing edge of the sheet P.

FIG. 25B is a time chart of the flag portion 1034*c* of the sensor link 1034. A uniform rectangular wave is outputted until the sheet P has completely passed through.

FIG. 25C is a compound of a time chart of the flag portion 1035*b* of the sensor link 1035 and a time Chart of the flag portion 1034*c* of the sensor link 1034 (it represents an actually observed waveform).

As described above, in the present embodiment, when a sheet passes, the timing at which the flag portion 1034*c* act on the photointerrupter 1036*b* and the timing at which the flag portion 1035*b* acts on the photointerrupter 1036*b* differ from each other.

In the present embodiment, as shown in FIGS. 25A, 25B and 25C, the rectangular wave by the flag portion 1034*c* continues to the pulse wave by the flag portion 1035*b*. The pulse when the flag portion 1035*b* is returned to the home position is buried in the rectangular wave by the flag portion 1034*c*. Accordingly, by monitoring the photointerrupter between an area M (for detecting the flag portion 1035*b*) and an area N (for detecting the flag portion 1034*c*) shown, for example, in FIG. 25C, it becomes possible to detect the flag portion 1035*b* and the flag portion 1034*c* independently of each other by a single photointerrupter.

Accordingly, it becomes possible to use the photointerrupter 1036*b* in common. That is, it becomes possible to realize sheet width detection and sheet passing detection in a single sensor, and it becomes possible to provide an apparatus of a lower cost and having a higher function.

Fifth Embodiment

Fifth Embodiment of the present invention will hereinafter be described. In the following description, chiefly the differences of the present embodiment from third and fourth Embodiments will be described, and constituent portions similar to those in third and fourth Embodiments are given the same reference characters and need not be described.

Figure 26:
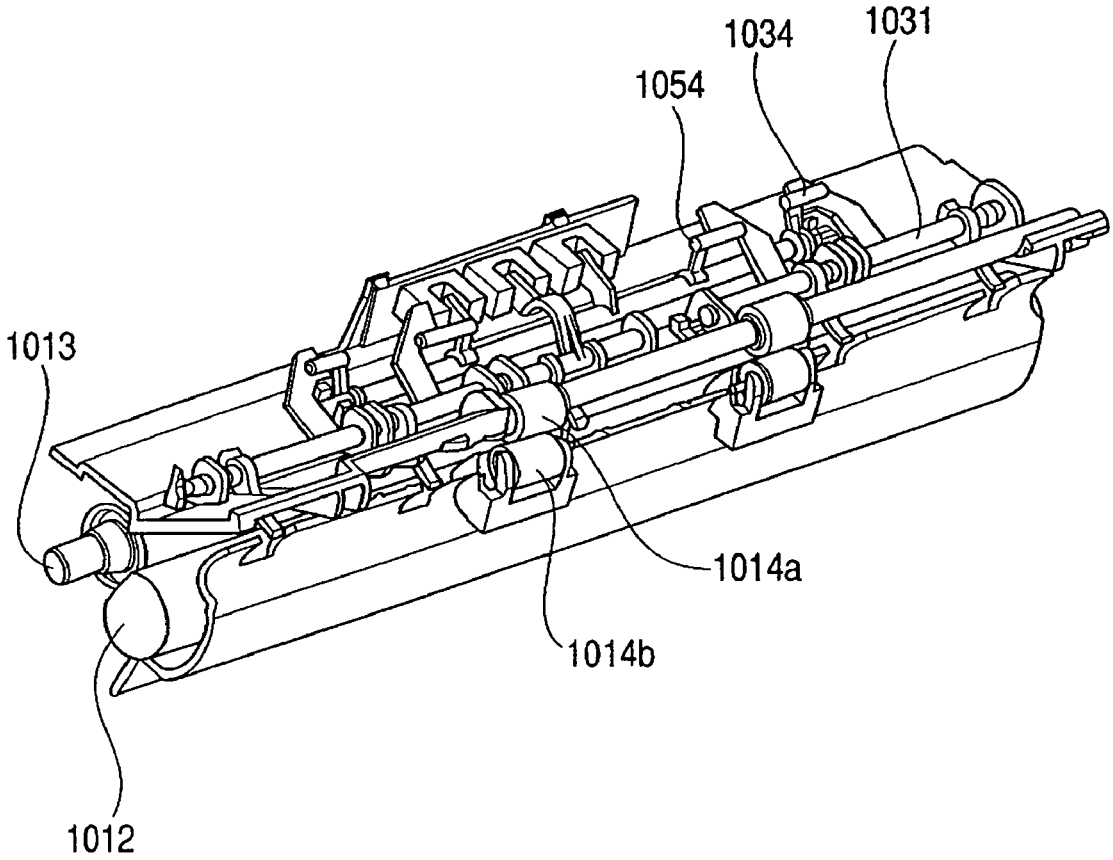
FIG. 26 is a schematic perspective view showing the discharging portion of an image forming apparatus carrying thereon a sheet size detecting apparatus according to fifth Embodiment.
Figure 27A:
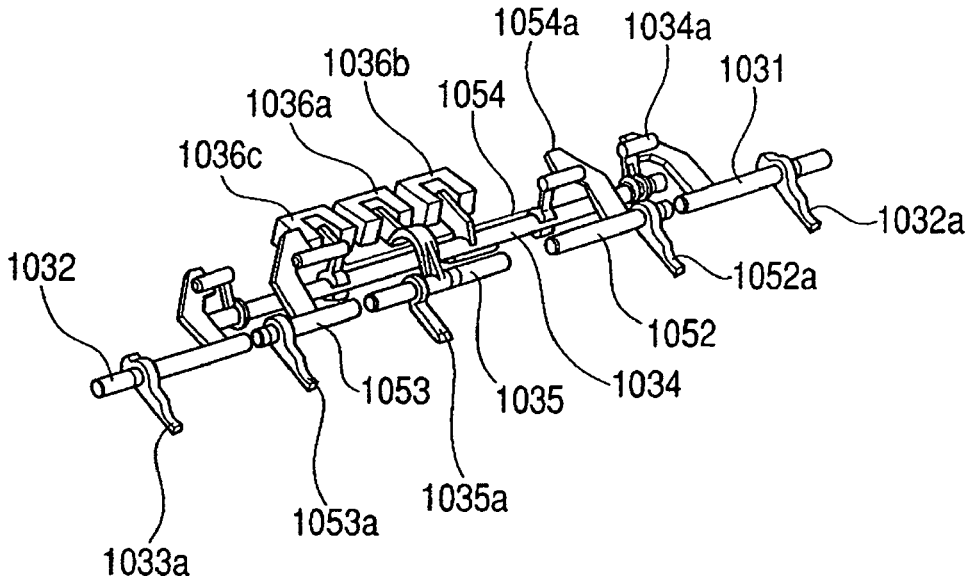
FIGS. 27A and 27B are exploded views of parts used in the sheet size detecting apparatus according to fifth Embodiment.
Figure 27B:
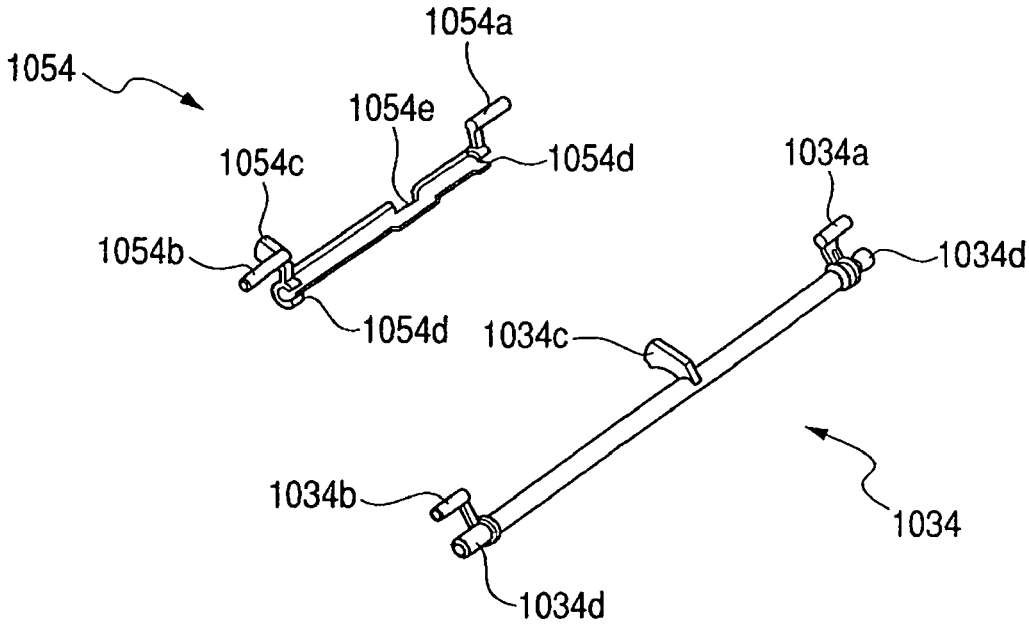

FIG. 26 is a schematic perspective view representing fifth Embodiment of the present invention. FIGS. 27A and 27B show only a sheet size detecting mechanism and a sheet discharge detecting mechanism taken out of FIG. 26. In the construction of the present embodiment, the following four parts are added to the discharging portion in third Embodiment. That is, a third arm 1052, a fourth arm 1053, a sensor link 1054 having its pivotal movement regulated by the third arm and the fourth arm, and a photointerrupter 1036*c* on which the sensor link 1054 acts.

The third arm 1052 and the fourth arm 1053 are disposed coaxially with the first arm 1032 and the second arm 1033. The first arm 1032 and the second arm 1033 are axially shortened by the third arm 1052 and the fourth arm 1053 having been added. Also, the sensor link 1034 is axially extended to a location connectable to the first arm 1032 and the second arm 1033. The sensor link 1054 is coaxially fitted to the sensor link 1034 by the use of two snap fit portions 1054*d*, and the sensor links 1034 and 1054 are designed to be rotatable independently of each other. Also, the sensor link 1054 is provided with a cut-away portion 1054*e* so that the flag portion 1034*b* of the sensor link 1034 may be rotatable. The sensor links are supported by first and second arms 1052 and 1053 through supported portions 1054*a* and 1054*b*.

The connection construction of the sensor portion added in the present embodiment is similar to the sensor construction in third Embodiment, and the epitome of the operation thereof need not be described.

By the apparatus being constructed as in the present embodiment, the sensor link 1054 has a flag portion 1054*c* for intercepting the light from the photointerrupter 1036*c*.

As described above, in the present embodiment, the number of arms and the number of the photointerrupters are made greater than in third Embodiment and therefore, even if a sheet of a size smaller than the distance between the contact portion 1032*a* of the first arm and the contact portion 1033*a* of the second arm and larger than the distance between the contact portion 1052*a* of the third arm and the contact portion 1053*a* of the fourth arm (a sheet of a medium size) is conveyed departing from a regular conveyance reference (in the present embodiment, the center of the conveying path in the width direction thereof), it can be discriminated that the sheet is a sheet of a medium of a size smaller than the distance between the contact portion 1052*a* of the third arm and the contact portion 1053*a* of the fourth arm (a sheet of a small size) is conveyed departing from the regular conveyance reference (in the present embodiment, the center of the conveying path in the width direction thereof), it can be discriminated that the sheet is a sheet of a small size. As described above, sheets of three sizes, i.e., a large size, a medium size and a small size, can be accurately discriminated by the two photointerrupters 1036*b* and 1036*c*.

In the present embodiment, the pivot shafts of a plurality of arms are disposed coaxially with one another, but if there is a surplus in the space, the shafts may be shifted. Of course, however, the coaxial disposition of the pivot shafts of the plurality of arms better leads to the possibility of constructing the apparatus compactly.

As described above, according to first to fifth Embodiments, it is possible to provide a sheet size detecting apparatus which can suppress the cost (suppress the number of sensors) and yet, can prevent the wrong detection of the sheet size.

The present invention is not confined to the above-described embodiments, but covers modifications within the technical idea thereof.

This application claims priority from Japanese Patent Application Nos. 2005-189932 filed on Jun. 29, 2005, 2005-318609 filed on Nov. 1, 2005 and 2006-171827 filed on Jun. 21, 2006 which are hereby incorporated by reference herein.

What is claimed is:

1. A sheet size detecting apparatus comprising:

a first arm moved by a moving sheet contacting therewith;

a second arm moved by the moving sheet contacting therewith, said second arm being disposed at a location differing from that of said first arm in a direction orthogonal to the movement direction of the sheet;

a sensor; and an actuator acting on said sensor, and wherein said actuator is not moved when only one of said first arm and said second arm is moved by the contact of the sheet, and is moved when both of said first arm and said second arm are moved by the contact of the sheet, wherein the output level of said sensor when only one of said first arm and said second arm has been moved is the same as the output level thereof when neither of said first arm and said second arm is moved, and the output level of said sensor when both of said first arm and said second arm have been moved differs from the output level thereof when neither of said first arm and said second arm is moved, and wherein said first arm has a first regulating portion for regulating the movement of said actuator, said second arm has a second regulating portion for regulating the movement of said actuator, and said actuator is moved only when both said first regulating portion and said second regulating portion are moved by the contact of said first arm and said second arm with the sheet.

2. A sheet size detecting apparatus according to claim 1, wherein said first arm is disposed in an area differing from an area in which said second arm is disposed, in a direction orthogonal to the movement direction of the sheet with a conveyance reference of the sheet as a boundary.

3. A sheet size detecting apparatus comprising:

a first arm moved by a moving sheet contacting therewith;

a second arm moved by the moving sheet contacting therewith, said second arm being disposed at a location differing from that of said first arm in a direction orthogonal to the movement direction of the sheet;

a sensor; and an actuator for acting on said sensor;

wherein said actuator is not moved when one of said first arm and said second arm is moved by the contact of the sheet, and is moved when both of said first arm and said second arm are moved by the contact of the sheet, and wherein said first arm has a first regulating portion for regulating the movement of said actuator, said second arm has a second regulating portion for regulating the movement of said actuator, and said actuator is moved only when both said first regulating portion and said second regulating portion are moved by the contact of said first arm and said second arm with the sheet.

4. A sheet size detecting apparatus according to claim 3, wherein said first arm is disposed in an area differing from an area in which said second arm is disposed, in a direction orthogonal to the movement direction of the sheet with a conveyance reference of the sheet as a boundary.

5. A sheet size detecting apparatus according to claim 3, further comprising a center arm provided at a location sheets of all sizes pass, and wherein a pivot shaft of said center arm is coaxial with an imaging shaft linking a pivot shaft of said first arm and a pivot shaft of said second arm.

6. A sheet size detecting apparatus according to claim 5, further comprising a second sensor on which an actuator portion of said center arm acts.

7. A sheet size detecting apparatus according to claim 3, further comprising a center arm provided at a location sheets of all sizes pass, and wherein said actuator and an actuator portion of said center arm act on said sensor.

8. A sheet size detecting apparatus according to claim 7, wherein a home position of a sheet contact portion of said center arm differs from home positions of the sheet contact portions of said first and second arms in the conveyance direction of the sheet.

* * * * *